US008109191B1

(12) United States Patent
Rudakevych et al.

(10) Patent No.: US 8,109,191 B1
(45) Date of Patent: Feb. 7, 2012

(54) REMOTE DIGITAL FIRING SYSTEM

(75) Inventors: Pavlo E. Rudakevych, Arroyo Grande, CA (US); Mike E. Ciholas, Evansville, IN (US); Robert T. Pack, Nashua, NH (US)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 12/469,255

(22) Filed: May 20, 2009

Related U.S. Application Data

(60) Division of application No. 11/347,557, filed on Feb. 3, 2006, now Pat. No. 7,559,269, which is a continuation-in-part of application No. 11/024,243, filed on Dec. 28, 2004, now Pat. No. 7,143,696, which is a continuation of application No. 10/319,853, filed on Dec. 13, 2002, now Pat. No. 6,860,206.

(60) Provisional application No. 60/340,175, filed on Dec. 14, 2001.

(51) Int. Cl.
*F41A 19/00* (2006.01)

(52) U.S. Cl. ..... 89/28.05; 89/41.01; 89/1.11; 700/245

(58) Field of Classification Search ..... 89/27.11, 89/41.01, 1.11, 28.05; 102/206; 700/245; 701/1, 2; 235/404
See application file for complete search history.

(56) References Cited

U.S. PATENT DOCUMENTS

| | | | |
|---|---|---|---|
| 3,711,638 | A | 1/1973 | Davies |
| 3,828,458 | A | 8/1974 | Skone-Palmer |
| 3,888,181 | A | 6/1975 | Kups |
| 4,012,860 | A | 3/1977 | Auger |
| 4,196,653 | A | 4/1980 | Jackson |
| 4,205,589 | A | 6/1980 | Engler et al. |
| 4,234,850 | A | 11/1980 | Collins |
| 4,253,132 | A | 2/1981 | Cover |
| 4,256,013 | A | 3/1981 | Quitadama |
| 4,674,047 | A | 6/1987 | Tyler et al. |
| 4,682,435 | A | 7/1987 | Heltzel |

(Continued)

FOREIGN PATENT DOCUMENTS

| | | |
|---|---|---|
| DE | 33 17 376 | 11/1984 |

(Continued)

OTHER PUBLICATIONS

R. Crites; Chapter 11: Intermittent and Recirculating Packed Bed Filters; Small and Decentralized Wastewater Management Systems; 1998 pp. 703-760 WCB/McGraw-Hill NY NY.

*Primary Examiner* — Michelle Clement
(74) *Attorney, Agent, or Firm* — Fish & Richardson P.C.

(57) ABSTRACT

A remote digital firing system for selectively firing a plurality of remote mission payloads. The remote digital firing system includes a first set of firing circuits communicatively coupled to and operative to fire a corresponding first set of remote mission payloads and a second set of firing circuits communicatively coupled to and operative to fire a corresponding second set of remote mission payloads. The remote digital firing system includes a firing control panel communicatively linked to the first and second sets firing circuits, a first digital code plug configured to be integrated in communicative combination with each firing circuit of the first set and the firing control panel, a second digital code plug configured to be integrated in communicative combination with each firing circuit of the second set and the firing control panel, and a payload selector switch for selecting a remote mission payload.

9 Claims, 16 Drawing Sheets

U.S. PATENT DOCUMENTS 4,685,396 A 8/1987 Birse et al.
4,718,187 A 1/1988 Blake
4,869,008 A 9/1989 Rasmussen
4,884,506 A 12/1989 Guerreri
5,020,411 A 6/1991 Rowan
5,090,321 A 2/1992 Abouav
5,272,955 A 12/1993 Bond et al.
5,359,576 A 10/1994 Bunner et al.
5,442,358 A 8/1995 Keeler et al.
5,520,114 A 5/1996 Guimard et al.
5,563,366 A 10/1996 La Mura et al.
5,636,464 A 6/1997 Ciluffo
5,764,888 A 6/1998 Bolan et al.
5,767,437 A 6/1998 Rogers
5,924,232 A 7/1999 Rhoden et al.
5,949,015 A 9/1999 Smith et al.
5,953,844 A 9/1999 Harling et al.
5,966,859 A 10/1999 Samuels
6,009,791 A 1/2000 Medlin
6,113,343 A 9/2000 Goldenberg et al.
6,154,694 A 11/2000 Aoki et al.
6,173,651 B1 1/2001 Pathe et al.
6,174,288 B1 1/2001 Samuels
6,223,461 B1 5/2001 Mardirossian
6,237,462 B1 5/2001 Hawkes et al.
6,250,194 B1 6/2001 Brandl et al.
6,269,730 B1 8/2001 Hawkes et al.
6,283,034 B1 9/2001 Miles, Jr.
6,286,242 B1 9/2001 Klebes
6,332,400 B1 12/2001 Meyer
6,412,207 B1 7/2002 Crye et al.
6,449,892 B1 9/2002 Jenkins
6,490,977 B1 12/2002 Bossarte et al.
6,535,793 B2 3/2003 Allard
6,557,104 B2 4/2003 Vu et al.
6,624,744 B1 9/2003 Wilson et al.
6,679,158 B1 1/2004 Hawkes et al.
6,839,662 B2 1/2005 Schnatterly et al.
6,851,369 B2 * 2/2005 Hummel et al. ..... 102/200
6,860,206 B1 3/2005 Rudakevych et al.
6,951,071 B1 10/2005 Acosta et al.
7,047,863 B2 5/2006 Hawkes et al.
7,089,844 B2 8/2006 Becker
7,092,867 B2 8/2006 Huang et al.
7,143,696 B2 12/2006 Rudakevych et al.
7,159,500 B2 1/2007 John et al.
7,228,261 B2 6/2007 Leonard et al.
7,275,691 B1 10/2007 Wright et al.
7,339,456 B1 3/2008 Buckley et al.
7,370,583 B2 * 5/2008 Bokvist et al. ..... 102/200
7,469,623 B1 12/2008 Olcott
7,471,216 B2 12/2008 Chen et al.
7,559,269 B2 7/2009 Rudakevych et al.
7,587,854 B2 9/2009 Werner
7,600,339 B2 10/2009 Schumacher et al.
7,650,826 B2 1/2010 Son et al.
7,748,324 B2 7/2010 Sutcliffe
7,783,387 B2 8/2010 Calcagno
7,788,476 B2 8/2010 McNutt et al.
7,802,511 B2 9/2010 Doll et al.
RE41,916 E 11/2010 Bates et al.
2001/0033228 A1 10/2001 Kisreman et al.
2001/0043509 A1 11/2001 Green et al.
2001/0045883 A1 11/2001 Holdaway et al.
2003/0028257 A1 2/2003 Crawford et al.
2003/0074823 A1 4/2003 Golan
2004/0050240 A1 3/2004 Greene et al.
2005/0066808 A1 3/2005 Hawkes et al.
2005/0172912 A1 8/2005 Crist et al.
2005/0257676 A1 11/2005 Ealovega
2005/0262992 A1 12/2005 Becker
2006/0011082 A1 1/2006 Jacobson et al.
2006/0027127 A1 2/2006 Cerovic
2006/0044146 A1 3/2006 Ferguson et al.
2007/0044673 A1 3/2007 Hummel et al.
2007/0051235 A1 3/2007 Hawkes et al.
2007/0072662 A1 3/2007 Templeman
2007/0074438 A1 4/2007 Parhofer et al.
2007/0097592 A1 5/2007 Smith
2007/0105070 A1 5/2007 Trawick
2007/0119326 A1 5/2007 Rudakevych et al.
2007/0124979 A1 6/2007 Newkirk et al.
2007/0156286 A1 7/2007 Yamauchi
2007/0180749 A1 8/2007 Schumacher et al.
2007/0204745 A1 9/2007 Son et al.
2007/0209501 A1 9/2007 Ko
2008/0053300 A1 3/2008 Berkovich et al.
2008/0083344 A1 4/2008 Deguire et al.
2008/0121097 A1 5/2008 Rudakevych et al.
2008/0134555 A1 6/2008 Werner
2008/0202326 A1 8/2008 Carroll et al.
2008/0302264 A1 12/2008 Hummel et al.
2008/0307993 A1 12/2008 Chan et al.
2009/0107024 A1 4/2009 Doll et al.
2009/0158922 A1 6/2009 Werner
2009/0164045 A1 6/2009 Deguire et al.
2009/0205237 A1 8/2009 Gorali et al.
2009/0223104 A1 9/2009 Anzeloni
2009/0241763 A1 10/2009 Revord
2009/0255160 A1 10/2009 Summers
2009/0281676 A1 11/2009 Beavis et al.
2009/0300961 A1 12/2009 Ruhland et al.
2010/0083817 A1 4/2010 Son et al.
2010/0107464 A1 5/2010 Beckmann et al.
2010/0117888 A1 5/2010 Simon
2010/0175547 A1 7/2010 Hoffman
2010/0212482 A1 8/2010 Morin et al.
2010/0251880 A1 10/2010 Hektoen et al.
2010/0257769 A1 10/2010 Doll et al.
2010/0263524 A1 10/2010 Morin et al.
2010/0269391 A1 10/2010 Doll et al.
2010/0275768 A1 11/2010 Quinn
2011/0005847 A1 1/2011 Andrus et al.

FOREIGN PATENT DOCUMENTS

EP 76960 A2 * 4/1983
EP 175854 A1 * 4/1986
EP 0 433 697 6/1991
WO WO 0026607 * 5/2000
WO WO 2004020934 A1 * 3/2004

* cited by examiner

REMOTE DIGITAL FIRING SYSTEM

CROSS REFERENCE TO RELATED APPLICATIONS

This U.S. patent application is a divisional of, and claims priority under 35 U.S.C. §121 from, U.S. patent application Ser. No. 11/347,557, filed on Feb. 3, 2006, which is a continuation-in-part of, and claims priority under 35 U.S.C. §120 from, U.S. patent application Ser. No. 11/024,243, filed on Dec. 28, 2004 (now U.S. Pat. No. 7,143,696), which is a continuation of, and claims priority under 35 U.S.C. §120 from, U.S. patent application Ser. No. 10/319,853, filed on Dec. 13, 2002 (now U.S. Pat. No. 6,860,206), which claims priority under 35 U.S.C. §119(e) to U.S. Provisional Application 60/340,175, filed on Dec. 14, 2001. The disclosures of the prior applications are considered part of (and are hereby incorporated by reference in) the disclosure of this application.

BACKGROUND OF THE INVENTION (1) Field of the Invention

The present invention relates generally to devices for remotely activating munitions, and more specifically to a remote digital firing system comprising a firing circuit, a firing control panel, and a digital code plug that is instrumental in generating and storing one-time random session variables at the firing circuit and securely transferring such session variables to the firing control panel for operation of the firing system. The present invention allows secure control of the remote digital firing system over the same insecure radio link as, for example, control of a mobile robot.

(2) Description of Related Art

Existing firing circuit control systems have required a separate communication channel to ensure safety. The present invention overcomes this limitation by allowing all aspects of a remote device to be controlled over a single communications channel while maintaining the safety of the firing system.

In addition, existing systems for switching the output relied upon discrete digital outputs from the microcontroller activating the switch devices (relays or FETs). This presents a risk in that failure of the microcontroller or software can activate the system. The present invention substantially reduces this risk and reduces the safety criticality of the embedded software.

Existing systems also have no provision to prevent a "replay attack," where a hostile party can record the transmitted control signal while jamming the receiver, than play the recorded signal at a later time exposing personnel to harm.

BRIEF SUMMARY OF THE INVENTION

These and other objects of the present invention are achieved by a remote digital firing system for firing of a remote mission payload, comprising a firing circuit communicatively coupled to and operative to fire the remote mission payload, a firing control panel communicatively linked to said firing circuit, and a digital code plug configured to be integrated in communicative combination with said firing circuit and said firing control panel, wherein said firing circuit is operative, with said digital code plug integrated in communicative combination therewith, to generate and write one-time random session variables to said digital code plug and to simultaneously store said one-time random session variables internally in said firing circuit, wherein said firing control panel is operative, with said digital code plug integrated in communicative combination therewith, to generate and transmit messages having said one-time random session variable embodied therein to said firing circuit, and wherein said firing circuit validates said messages by comparing said one-time random session variables embodied in said messages with said internally stored one-time random session variables prior to firing the remote mission payload.

In addition, the remote digital firing system of the present invention allows for multiple firing circuits per vehicle, and multiple vehicles, all controlled by a single digital code plug and firing control panel.

BRIEF DESCRIPTION OF THE DRAWINGS

A more complete understanding of the present invention and the attendant features and advantages thereof may be had by reference to the following detailed description of the invention when considered in conjunction with the accompanying drawings wherein.

DETAILED DESCRIPTION OF THE INVENTION

Figure 1:
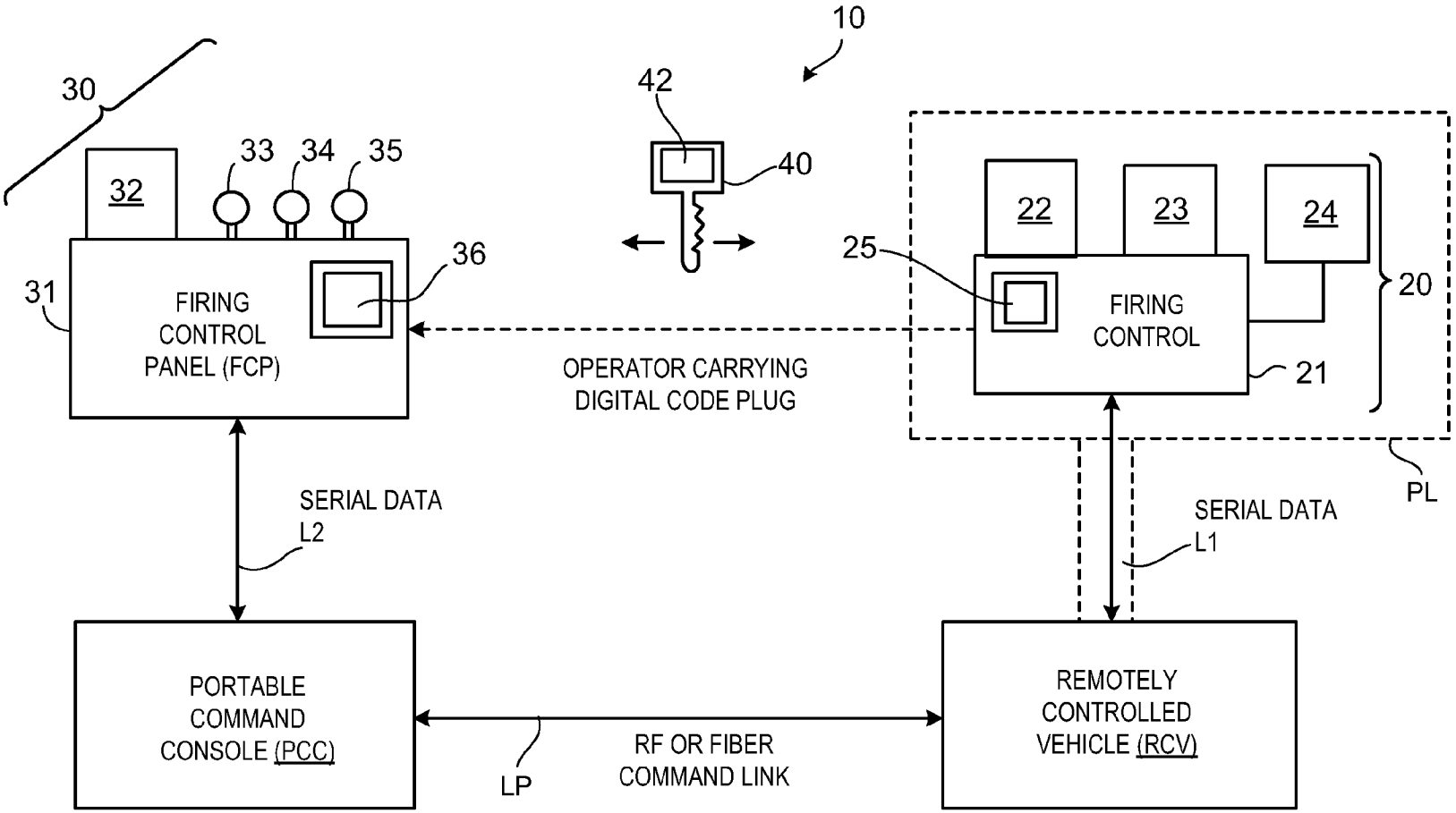
FIG. 1 is a schematic representation of a preferred embodiment of a remote digital firing system according to the present invention.

Referring now to the drawings wherein like reference numerals identify similar or corresponding elements throughout the several views, FIG. 1 illustrates a preferred embodiment of a remote digital firing system 10 according to the present invention. The firing system 10 is operative to allow weapon firing, e.g., ordnance disposal, in a safe and reliable manner, even using unreliable and insecure communication channels such as interconnected computers, radio and/or wire links, and/or optical fibers, through the use of one-time random session codes, rolling codes, and challenge-response protocols.

The remote digital firing system 10 comprises a firing circuit 20, a firing control panel 30, and a digital code plug 40. For the described embodiment, the firing circuit 20 and the firing control panel 30 are integrated in combination with secondary equipment as described below. The firing circuit 20 and the firing control panel 30 of the described embodiment are serially linked for communication by links L1, L2, and LP wherein L1 and L2 are internal links between the firing circuit 20 and the firing control panel 30 and the respective secondary equipment and LP is an external link between such secondary equipment, e.g., wireless, electrical, optical, or combinations thereof. The external link LP can pass through multiple computers, radio systems, optical tethers, and/or combinations thereof. Due to the particular features of the remote digital firing system 10 according to the present invention, the primary serial communication link LP can be shared with other applications, e.g., an insecure radio communications links for control a mobile robot, without risk that signals from such applications will adversely impact the operation of the firing system 10, e.g., inadvertent activation of the firing system 10.

The firing circuit 20 is typically integrated in combination with a remotely controlled vehicle RCV of the type manufactured by the iRobot Corporation, with the internal link L1 providing the communication path between the firing circuit 20 and the circuitry of the vehicle RCV. See, e.g., U.S. patent application Ser. No. 09/846,756, filed 1 May 2001, entitled Method and System for Remote Control of Mobile Robot. The firing circuit 20 is communicatively coupled to an electrically-activated payload PL such as a detonator (or disruptor) and operative to actuate the payload PL when the firing circuit 20 is activated to effect weapon or ordnance disposal. For example, actuation of a payload PL such as a disruptor charge by a detonator causes high kinetic energy masses to separate the detonation mechanism from the primary explosive in a targeted ordnance device. For the described embodiment, the firing circuit 20 is mounted in a payload manipulator at end of a deployment mechanism of the vehicle RCV, which allows the payload PL to be manipulated into close proximity with the ordnance device while the vehicle RCV remains spatially separated therefrom.

The firing circuit 20, which is described in further detail below, includes a microcontroller 21, a modifiable, read-only memory module 22 such as an EEPROM or flash memory, an application module 23, a hardware random noise generator 24, and a set of indicator lights 25, e.g., LEDs. The microcontroller 21 is operative, using instruction sets stored in the application module 23, to implement and manage the functions of the firing circuit 20, including, but not necessarily limited to:

(1) Transmitting and receiving message traffic to/from the firing control panel 30 in accordance with a prescribed communication protocol.

(2) Automatically generating and storing a set of one-time random session variables, i.e., an encryption key, and command codes for a Safe/Disarm operation, an Arm operation, and a Fire operation, and a rolling code sequence any time the digital code plug 40 is integrated in communication combination with the firing circuit 20.

(3) Disabling the firing circuit 20 when the digital key plug 40 is inserted in communicative combination with the firing circuit 20 (software redundancy to the electronic disable provided by hardware configuration of the firing circuit 20).

(4) Comparing the Safe/Disarm code session variable stored in the memory module 22 with the corresponding Safe/Disarm code session variable received via message traffic from the firing control panel 30.

(5) Implementing a decryption algorithm to encode and decode message traffic to/from the firing control panel 30 as described below in further detail in the disclosure relating to the prescribed communication protocol.

(6) Automatically generating a Challenge message in response to a Request-for-Challenge message received from the firing control panel 30.

(7) Validating Arm and Fire command messages received from the firing control panel 30 by comparing the Arm or Fire code embodied in such command message with the Arm or Fire code stored in the firing circuit 20.

(8) Selectively operating the firing circuit 20 in response to validated command messages generated by the firing control panel 30, such operations including Safe/Disarm, Arm, and Fire (activation) of the firing circuit 20 (see description below in connection with FIG. 3).

(9) Generating verification messages in response to validated Safe/Disarm, Arm, and Fire command messages from the firing control panel 30.

(10) Automatically safing/disarming the firing circuit 20 under predetermined conditions.

(11a) Automatically implementing hardware checks of the components comprising the firing circuit 20 after successful execution of a Fire command message.

(11b) Automatically disabling the remote digital firing system 10 if a hardware fault is detected; concomitantly set hardware fault indication.

(12) Disabling the firing circuit 20 in response to receipt of the omega rolling code sequence number from the firing control panel (see function (5) description for the firing control panel 30 below).

(13) Continually implementing a constant period loop, i.e., the master loop, to:

(i) determine if the digital code plug 40 has been integrated in communicative combination with the firing circuit 20;

(ii) parse incoming message characters;

(iii) update condition of the status indicators;

(iv) update internal counters;

(v) check hardware status against the current state of the firing circuit 20 implemented via the instruction sets of the application module 23; and (vi) generate a time based entropy source for random number generation by counting rapidly while idle and waiting for the next iteration of the loop.

The foregoing functional capabilities ensure that no double bit error in the instruction sets of the application module 23, the memory module 24, or the program counter can cause accidental activation of the remote digital firing system 10. In some preferred embodiments, double bit error safety is accomplished in software by using state enumerators with large hamming distances, and using redundant global variables to restrict hardware access in combination with the state variables, where any inconsistency triggers an error state.

The memory module 22 is used to store the one-time random session variables for use by the firing circuit 20 during operation of the remote digital firing system 10. The application module 23 comprises the instruction sets used by the microcontroller 21 to implement the functions of the firing circuit 20 described above and the decryption algorithm utilized by the firing circuit 20 to decrypt Challenge and command messages received from the firing control panel 30. This decryption algorithm is also used by the firing circuit 20 to encrypt the corresponding verification messages transmitted to the firing control panel 30 in accordance with the prescribed communication protocol. Alternatively, these instruction sets and the decryption algorithm can be stored in the memory module 23. The instruction sets for the firing circuit 20 can be implemented as hardware, software, firmware, or combinations thereof.

Figure 2:
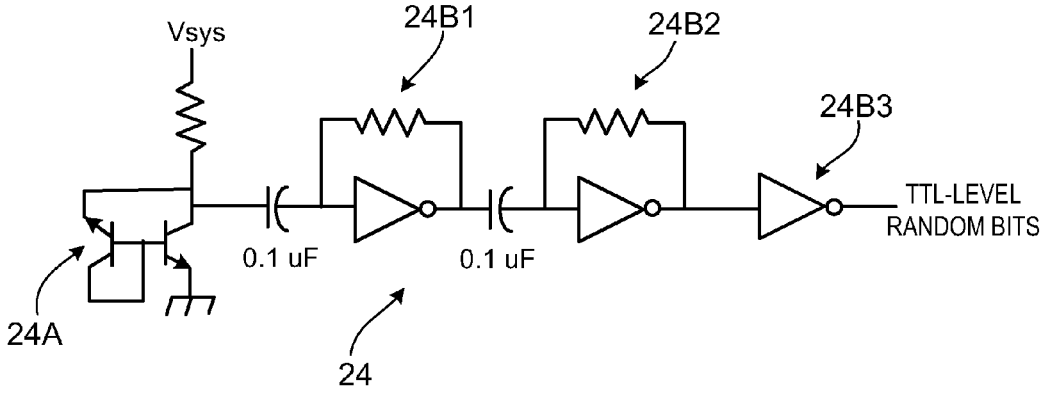
FIG. 2 depicts one embodiment of a hardware random noise generator for the firing circuit of the remote digital firing system according to the present invention.

FIG. 2 illustrates an embodiment of the hardware random noise generator 24 of the firing circuit 20 that is operative to produce random binary bits that comprise the one-time random session variables, i.e., the encryption key, the SAFE/DISARM code, the ARM code, and the FIRE code, that govern the operation of the firing system 10 according to the present invention. This hardware random noise generator 24 comprises a reverse-biased PN transistor junction 24A to produce amplified avalanche noise that is subsequently filtered through several logic gates 24B1, 24B2, 24B3. The circuit of FIG. 2 is not highly tuned and operates effectively over a wide range of part tolerances. One of skill in the art will recognize that any one of several hardware random noise generators known in the art could be used. Bias in the generated bit stream is eliminated by repetitive XOR sampling. The functionality of the circuit is verified by the microcontroller software by checking for all ones or all zeros in the output stream. While the firing circuit 20 of the present invention can utilize a pseudorandom software algorithm to generate random numbers for the encryption key and variable session codes, it should be appreciated that such a software algorithm can be subjected to predictive crypto analysis.

For the described embodiment, the encryption key comprises 128 randomly-generated bits, the SAFE/DISARM code comprises 32 randomly-generated bits, the ARM code comprises 32 randomly-generated bits, and the FIRE code comprises 32 randomly-generated bits. These key and code lengths are sufficient to deter brute force decryption attacks that would be successful in a reasonable amount of time. Of course, one skilled in the art will appreciate that other bit lengths can be utilized for the key and codes and still be within the scope of the remote digital firing system 10 according to the present invention. The random noise generator 24 is only operative when the digital code plug 40 is integrated in communicative combination with the firing circuit 20.

The described embodiment of the firing circuit 20 includes two indicator lights 25, a red indicator light 25A and a green indicator light 25B, that provide visual indications of the status of the firing circuit 20 to the system operator. An illuminated green indicator light 25B indicates that the firing circuit 20 is in a disarmed (safe) state, a steadily illuminated red indicator light 25B indicates that the firing circuit 20 is armed (ready to fire). while a flashing illuminated red indicator light 25A indicates a malfunction associated with the firing circuit 20. The status indications provided by these indicator lights 25 are described below in further detail in conjunction with the description of a nominal operating method for the remote digital firing system 10 according to the present invention.

The firing control panel 30 is typically integrated in combination with a portable command console (PCC) or Operator Control Unit (OCU) for mobility, with the internal link L2 providing the communication path between the firing control panel 30 and the circuitry of the console PCC. The primary serial communications link LP described above provides the communication pathway between the portable command console PCC and the vehicle RCV.

The firing control panel 30 includes a microcontroller 31, an application module 32, a link test mechanism 33, an arming mechanism 34, a firing mechanism 35, and a set of indicator lights 36. The microcontroller 31 is operative, using instruction sets stored in the application module 32, to implement and manage the functions of the firing control panel 30, including, but not necessarily limited to:

(1) Transmitting and receiving message traffic to/from the firing circuit 20 in accordance with the prescribed communication protocol.

(2) Retrieving and processing the one-time random session variables and the rolling code sequence stored in the digital code plug 40 in connection with the generation of command messages.

(3) Automatically implementing a link test with the firing circuit 20 upon insertion of the digital key plug 40 in communicative combination with the firing control panel 30 (includes reading the SAFE/DISARM CODE, the encryption key, and the rolling code sequence from the digital key plug 40); link test will also be automatically implemented if any of the circumstances described in paragraphs (9) (iii)-(v) exist.

(4) Implementing the link test in response to actuation of the link-test mechanism 33 by a system operator.

(5) Transmitting the omega rolling code sequence (rolling code sequence number 255 for the described embodiment) when the digital code plug 40 is removed from communicative combination with the firing control panel 30 while simultaneously actuating the link-test mechanism 33 (see description of function (12) of the firing circuit 20 above).

(6) Erasing the stored contents (e.g., one-time random session variables and rolling code sequence) of the digital code plug 40 when the link-test mechanism 33 is actuated while simultaneously integrating the digital code plug 40 in communicative combination with the firing control panel 30;

(7) Implementing an encryption algorithm to encode and decode command message traffic to/from the firing circuit 20 as described below in further detail in the disclosure relating to the prescribed communication protocol.

(8) Automatically generating the Request-for-Challenge message and an ARM command message in response to manipulation of the arming mechanism 34 by an operator and transmitting such Request-for-Challenge and ARM command messages to the firing circuit 20 (the ARM code is read from the digital code plug 40 as a precursor to generation of the ARM command message).

(9a) Implementing an arming mechanism 34 check to determine if it has been moved to the armed position within a predetermined time interval, e.g., twenty (20) seconds for the described embodiment; and (9b) Automatically generating, if (9a) is true, the Request-for-Challenge message and a FIRE command message in response to manipulation of the firing mechanism 35 by an operator and transmitting such Request-for-Challenge and FIRE command messages to the firing circuit 20 (the FIRE code is read from the digital code plug 40 as a precursor to generation of the FIRE command message).

(10) Validating Challenge messages received from the firing circuit 20 in response to corresponding Request-for-Challenge messages issued by the firing control panel 30, which includes a step of verifying that the applicable mechanism, i.e., the arming mechanism 34 or the firing mechanism 35, is still in the actuated position.

(11) Generating system error messages if:

(i) the firing mechanism 35 is actuated and the arming mechanism 33 is in the safe position;

(ii) the firing mechanism 35 is actuated while the link-test mechanism 33 is actuated;

(iii) the arming mechanism 34 is left in the armed position for more than the predetermined time interval (see paragraph (9a);

(iv) the link-test mechanism 33 is actuated while the arming mechanism 34 is in the armed position; and (v) the link-test mechanism 33 is actuated while the firing mechanism 35 is actuated.

The application module 32 comprises the instruction sets used by the microcontroller 31 to implement the functions of the firing control panel 30 described above and the encryption algorithm utilized by the firing control panel 30 to encrypt Request-for-Challenge and command messages transmitted to the firing circuit 20 in accordance with the prescribed communication protocol. This encryption algorithm is also used by the firing control panel 30 to decrypt the corresponding 'encrypted' verification messages received from the firing circuit 20. The instruction sets for the firing control panel 30 can be implemented as hardware, software, firmware, or combinations thereof.

The link-test mechanism 33 is operative, in response to manipulation by an operator, to generate a signal that causes the microcontroller 31 to implement the instruction set for generating and transmitting the SAFE/DISARM command message to the firing circuit 20. For the described embodiment, the link-test mechanism 33 is a push button. The arming mechanism 34 is operative, in response to manipulation by an operator, to generate a signal that causes the microcontroller 31 to implement the instruction sets for generating and transmitting the Request-for-Challenge and ARM command signals, respectively, to the firing circuit 20. For the described embodiment, the arming mechanism 34 is 90° rotary selector switch. The firing mechanism 35 is operative, in response to manipulation by an operator, to generate a signal that causes the microcontroller 31 to implement the instruction sets for generating and transmitting the Request-for-Challenge and FIRE command messages, respectively, to the firing circuit 20. For the described embodiment the firing mechanism 35 is a locking, transient toggle switch, i.e., the toggle must be pulled to disengage a lock mechanism before the switch can be actuated. Preferably both the arming and firing mechanisms 34, 35 are single pole, double throw type switches tied to two input lines so that for a switch manipulation to generate a signal, two input bits must be changed before the microcontroller 31 recognizes the new switch position as valid and implements the corresponding instruction sets.

The described embodiment of the firing control panel 30 includes two indicator lights 36, a red indicator light 36A and a green indicator light 36B that provide visual indications of the status of the firing control panel 30. An illuminated green indicator light 36B indicates that the firing circuit 20 is in a disarmed (safe) state, a steadily-illuminated red indicator light 36A indicates that the firing control panel 30 is armed (ready to fire), and a flashing illuminated red indicator light 25A indicates a malfunction associated with the firing control panel 30. The status indications provided by these indicator lights 36 are described below in further detail in conjunction with the description of a nominal operating sequence of the remote digital firing system 10 according to the present invention.

The digital code plug 40 provides the means for securely transferring the one-time random session variables and the rolling code sequence generated by the firing circuit 20 to the firing control panel 30 and for temporarily storing such session variables and the rolling code sequence for use by the firing control panel 30 during operation of the remote digital firing system 10. The digital code plug 40 is a mechanism or device that is physically and functionally configured to be temporarily integrated in communicative combination with the firing circuit 20 and the fire control panel 30. For the described embodiment, the portable control console PCC was configured to physically receive the digital code plug 40, e.g., via a digital key socket, while the vehicle RCV is configured to physically receive the digital code plug 40, e.g., via a digital key socket. One skilled in the art will appreciate that the firing circuit 20 and/or the firing control panel 30 can be configured to directly physically receive the digital code plug 40. The digital code plug 40 includes a memory module 42, e.g., ROM, EEPROM, flash memory, for storing the one-time random session variables and the rolling code sequence.

For the described embodiment, the digital code plug 40 was a Dallas DS2433-Z01 4K EEPROM that uses a proprietary interface for reading and writing. The EEPROM was encased in a waterproof metal key assembly, which provided a complete electrical shield when this digital code plug 40 was integrated in communicative combination with the firing circuit 20. The metal key assembly was encased in a plastic case to facilitate handling and to improve the physical robustness of the digital code plug 40. One skilled in the art will appreciate that other mechanisms that include a digital storage capability can be used in conjunction with the remote digital firing system 10 according to the present invention to implement the functionality provided by the digital code plug 40 described herein, e.g., a smart card.

When the digital code plug 40 is integrated in communicative combination with the firing circuit 20, the hardware random noise generator 24 is activated by the microcontroller 21 to generate (in combination with a time based entropy source) the random binary bits that form the encryption key, the SAFE/DISARM code, the ARM code, and the FIRE code comprising the one-time random session variables, and the rolling code sequence is initialized to zero. The microcontroller 21 is operative to simultaneously write these one-time random session variables and the rolling code sequence into the memory module 42 of the digital code plug 40 and the memory module 23 of the firing circuit 20.

The remote digital firing system 10 according to the present invention utilizes a prescribed communication protocol to ensure the operational integrity and security of the firing system 10, i.e., eliminating or substantially minimizing the likelihood of operation of the firing system 10 as a result of spurious message traffic or electrical signals generated by outside sources or the firing system 10 itself. This prescribed communication protocol includes four different message types, i.e., status messages, request—challenge messages, command messages, and verification messages, predefined message characters or symbols, a predetermined message data block format, and a singular symmetric encryption/decryption scheme for all request—challenge, command, and verification message traffic as described below.

(a) Use of a message-originator character or symbol to identify the message traffic initiator, i.e., as either the firing circuit 20 or the firing control panel 30. For the described embodiment, the symbol "@" is used to identify the firing circuit 20 as the message originator and the symbol "$" is used to identify the firing control panel 30 as the message originator. This message-originator character/symbol is always the first element of any message and is transmitted as clear text.

(b) Use of a predefined status character or symbol to identify operations involving the digital code plug 40. For the described embodiment, the character "K" identifies the integration of the digital code plug 40 in communicative combination with the firing circuit 20 or the firing control panel 30, and the character/symbol "k" identifies the removal of the digital code plug 40 from communicative combination with the firing circuit 20 or the firing control panel 30. These two symbols can be detected by the RCV or PCC, as applicable, and used to disable or enable vehicle functions, such as disabling the drive motors of the RCV while the key is inserted to prevent inadvertent motion. The status character/symbol is always the last element of a status message and is transmitted as clear text. For the described embodiment, which includes an identifier for a plurality of target systems (as discussed below), this predefined character/symbol is the third (and last) element of a status message.

(c) Generation of an automatic status message in conjunction with the use of the digital code plug 40 as described in paragraph (b), i.e., whenever the digital code plug 40 is integrated in or removed from communicative combination with the firing circuit 20 or the firing control panel 30. For the described embodiment, the status message consists of three elements (see Table II).

(d) A method of addressing messages to multiple firing circuits 20*n* (where n is an integer identifying individual firing circuits) from a single firing control panel 30, such that each message originating at the firing control panel 30 contains the address of the intended firing circuit 20*n* and each message originating at a firing circuit 20*n* contains its unique address. In this implementation, the address is a single hexadecimal character, allowing up to 16 devices, but one skilled in the art can easily expand the address space.

(e) A method of selecting the desired weapon, i.e., firing circuit 20*n*, by means of a rotary selector switch.

(f) The digital code plug 40 also contains the name of the weapon whose codes it contains. When using multiple firing circuits 20*n*, the name of the weapon selected by the user can be displayed on an LCD to clearly indicate which weapon has been selected.

(g) Whenever the selected weapon is changed with the rotary switch, the name of the newly selected weapon is transmitted over the serial link preceded by the address of the selected weapon and the "N" character (i. E. $0NICECAP) so the selected weapon can be displayed on the OCU. A link-test message is automatically generated and transmitted to the weapon selected via the rotary switch by means of the firing control panel 30.

(h) Generation of an automatic link-test message upon integration of the digital code plug 40 in communicative combination with the firing control panel 30. This link-test message is also generated any time the link-test mechanism 33 is actuated. This message is also automatically generated as a result of the detection of an operator error caused by improper activation sequence of the switches (see paragraph (11) description of this function of the firing control panel 30). For the described embodiment, the link-test message comprises the SAFE/DISARM command message described in further detail in paragraphs (i), (j), (k), and (m).

(i) Use of a predefined character or symbol to identify the command messages of the prescribed communication protocol, i.e., the SAFE/DISARM command message, the ARM command message, and the FIRE command message, the corresponding verification messages associated with each of these command messages, and the request-challenge messages. For the described embodiment, the command messages utilize the character "S" to identify the SAFE/DISARM command message, the character "A" to identify the ARM command message, and the character "F" to identify the FIRE message. For the verification messages, the described embodiment utilizes the character "V", in conjunction with the corresponding command message character/symbol, to identify verification messages, which indicates that the corresponding action has been executed by the firing circuit 20, i.e., safing or disarming of the firing circuit 20, arming of the circuit 20, or activating (firing) the firing circuit 20. The described embodiment uses the characters "R" and "C" to identify Request-for-Challenge and Challenge messages, respectively. The message-type character/symbol is always the last unencrypted element for any of the foregoing message types.

(j) Use of predefined, constant data block formats for the all request—challenge, command, and verification messages exchanged between the firing circuit 20 and the firing control panel 30. For the described embodiment, the data block format comprises 64 (sixty-four) bits for the request-challenge and command messages and 16 (sixteen) bits for the verification messages (all in hexadecimal format). One skilled in the art will appreciate that data block formats of other bit lengths can be used without departing from the scope of the remote digital firing system 10 of the present invention. The specific data block format for each of the various message types of the prescribed communication protocol are illustrated in Table I wherein the terminology "random number" indicates a variable required in the message validation process and the terminology "unspecified" indicates a variable that functions as a block filler, i.e., not used in the message validation process.

TABLE I

| MESSAGE TYPE | DATA BLOCK FORMAT |
|---|---|
| M1. Request for Challenge | 32 bits (unspecified)<br>16 bits (random number)<br>16 bits (unspecified) |
| M2. Challenge | 16 bits (random number challenge)<br>16 bits (unspecified)<br>16 bits (random number - from Request Msg)<br>16 bits (unspecified) |
| M3. SAFE/DISARM Command | 32 bits (SAFE/DISARM code - read from digital code plug 40)<br>8 bits (rolling code sequence - read from digital code plug 40)<br>16 bits (random challenge number - from Challenge Msg)<br>8 bits (unspecified) |
| M4. SAFE/DISARM Verification | 16 bits (random challenge number - from SAFE/DISARM Command Msg) |
| M5. ARM Command | 32 bits (ARM code - read from digital code plug 40)<br>16 bits (random challenge number - from Challenge Msg)<br>16 bits (unspecified) |
| M6. ARM Verification | 16 bits (random challenge number - from ARM Command Msg) |
| M7. FIRE Command | 32 bits (FIRE code - read from digital code plug 40)<br>16 bits (random challenge number - from Challenge Msg)<br>16 bits (unspecified) |
| M8. FIRE Verification | 16 bits (random challenge number - from FIRE Command Msg) |

(k) As depicted in Table I, the data block of the Safe/Disarm command message M3 includes a rolling code sequence of 8 (eight) bits. As initially stored in both the memory module 23 of the firing circuit 20 and the digital code plug 40, the rolling code sequence is a string of 0s (zeros). When the digital code plug 40 is integrated in communicative combination with the firing control panel 30, the microcontroller 31 is operative to read the rolling code sequence stored in the memory module 42 of the digital code plug 40, e.g., a string of 0s (zeros), and generate the SAFE/DISARM command message that includes this rolling code sequence. The microcontroller 31 is then operative to increment the rolling code sequence, e.g., by 1 (one), and store the incremented rolling code sequence, e.g., 00000001, in the memory module 42 of the digital code plug 40. When this SAFE/DISARM command message is received by the firing circuit 20, the microcontroller 21 compares the value of the rolling code sequence embedded in the SAFE/DISARM command message with the value of the rolling code sequence stored in the memory module 23. If the received rolling code sequence is greater than or equal to the stored rolling code sequence, then the received rolling code sequence of the SAFE/DISARM command message is accepted by the firing circuit 20 as valid. If the SAFE/DISARM command message M3 is accepted as valid by the firing circuit 20 (see paragraph (m)), the microcontroller 21 increments, e.g., by 1 (one), the rolling code sequence stored in the memory module 23. This validation procedure for the rolling code sequence is performed in conjunction with each transmission and reception of the link-test message (SAFE/DISARM command message M3), whether due to removal of and re-integration of the digital code plug 40 in communicative combination with the firing control panel 30, actuation of the link-test mechanism 33 by a system operator, or generation of the SAFE/DISARM command message as a result of a detected system error.

(l) Use of an automatic request—challenge message protocol between the firing circuit 20 and the firing control panel 30 prior to initiation of the ARM or FIRE command messages M5 or M7 by the firing control panel 30. Prior to initiating either the ARM Command or the FIRE Command, the firing control panel 30 automatically formats, encrypts, and transmits the Request-for-Challenge message M1 to the firing circuit 20 as a result of the actuation of the arming mechanism 34 or the firing mechanism 35, as applicable. In response to a Request-for-Challenge message M1, the firing circuit 20 is operative to format, 'encrypt' and transmit the Challenge message M2 to the firing control panel 30. Upon receipt of the Challenge message M2, the firing control panel 30 is automatically operative to 'decrypt' the Challenge message M2 (to access the random challenge number), to read the applicable ARM or FIRE code from the digital code plug 40, and to format, encrypt, and transmit the applicable command message to the firing circuit 20.

(m) Implementation of a validation protocol by the firing circuit 20 in connection with the SAFE/DISARM, ARM, and FIRE command messages M3, M5, or M7. This validation protocol comprises a comparison of the session variable, i.e., SAFE/DISARM code, ARM code or FIRE code, as applicable, embodied in the decrypted message data block with the corresponding session variable stored in the memory module 23 of the firing circuit 20. In addition, for the ARM and FIRE command messages M5, M7, the firing circuit 20 is further operative to compare the random number challenge embodied in the command message M5 or M7 with the random number challenge generated by the firing circuit 20 and incorporated in the preceding Challenge message M2 issued by the firing circuit 20.

(n) Use of validity windows in conjunction with: (i) receipt of the Challenge message M2 in response to the Request for Challenge message M1; and (ii) receipt of an ARM or FIRE command message M5 or M7 subsequent to transmission of the Challenge message M2 wherein such validity windows define established time limits for acceptance of such messages. The firing control panel 30 is configured to be responsive only to a Challenge message M2 received within an established validity window referenced from transmission of the Request-for-Challenge message M1. In a similar manner, the firing circuit 20 is configured to accept an Arm or Fire command message M5 or M7 from the firing control panel 30 only if such command is received within an established validity window referenced from transmission of the Challenge message M2. For the described embodiment, the established validity window is 2 (two) seconds for both the request—challenge protocol and reception of the command message. One skilled in the art will appreciate that the remote digital firing system 10 may use different time limits for the validity windows for message receipt constraints or a time value other than 2 (two) seconds for both of the message receipt constraints described above.

(o) Encryption of the data blocks of all request—challenge protocol, command, and verification message traffic between the firing circuit 20 and the fire control panel 30. The firing control panel 30 includes an algorithm for encrypting the data blocks of the Request-for-Challenge messages and the SAFE/DISARM, ARM, and FIRE command messages generated by the firing control panel 30 for transmission to the firing circuit 20. The firing circuit 20 includes an algorithm for decrypting the data blocks of the Request-for-Challenge messages and the SAFE/DISARM, ARM, and FIRE command messages received from the firing control panel 30. The firing circuit 20, however, does not include an encryption algorithm; nor does the firing control panel 30 include a decryption algorithm. However, inasmuch as remote digital firing system 10 of the present invention employs a symmetric cryptographic scheme, the decryption algorithm of the firing circuit 20 is utilized to 'encrypt' the cleartext data blocks of the Challenge and verification messages M1, M4, M6, M8 generated by the firing circuit 20. In a similar manner, the encryption algorithm of the firing control panel 30 is utilized to 'decrypt' the 'encrypted' data blocks of the Challenge and verification messages M1, M4, M6, M8 received from the firing circuit 20.

The singular encryption/decryption scheme for the remote digital firing system 10 of the present invention described in the preceding paragraph provides several tangible benefits. Since each microcontroller 21, 31 only utilizes one algorithm to perform both the encryption and decryption functions, the algorithm code stored in the respective memory module 23, 32 is significantly reduced. And since the firing control panel 30 includes only the encryption algorithm, encrypted command codes in the firing control panel 30 cannot be reconstructed since the decryption algorithm does not exist at the firing control panel 30. This guarantees that once the digital code plug 40 is removed from communicative combination with the firing control panel 30, the requisite responses to Challenge messages M2 cannot be generated at the firing control panel 30, i.e., the ARM Command message M5 or the FIRE command message M7.

In light of use of one-time random session variables and the limited number of messages that are subject to encryption under the prescribed communication protocol for the remote digital firing system 10 according to the present invention, the encryption algorithm for the firing system 10 need not possess a high degree of cryptographic security and need not be computationally intensive. Accordingly, the encryption algorithm implemented in the firing system 10 can be a relatively compact and low-overhead algorithm that enhances the computational speed of the remote digital firing system 10 of the present invention. The described embodiment of the firing system 10 utilizes the XTEA algorithm, which is an extension of the Tiny Encryption Algorithm.

(p) Responding to invalid command messages. An invalid command message is one wherein: (i) the cleartext string of the command message does not include the required characters/symbols—see paragraphs (a) and (i); or (ii) the session code embodied in the data block of the command message does not match the corresponding session code stored in the memory module 22 of the firing circuit 20. The firing circuit 20 is operative to ignore any invalid command message; in addition, for a type (ii) invalid message, the firing circuit 20 will automatically transmit a predefined character/symbol to the firing control panel 30 to indicate use of the wrong digital code plug 40.

In addition to the foregoing, the prescribed communication protocol for the remote digital firing system 10 according to the present invention can also be configured to include a predetermined character/symbol following the message-initiator identification character/symbol (see paragraph (a)), i.e., the second character/symbol of any message, that is used to identify up to sixteen different target systems where each vehicle RCV, firing circuit 20 combination comprises a target system. The embodiment described herein uses the "0" symbol as the target system identifier since the description provided herein is in terms of a single target system. This element is transmitted as clear text.

Table II illustrates the characteristics of the prescribed communication protocol for the remote digital firing system 10 according to the present invention as described above. Underlined segments of the message format identify the message types, i.e., Request-for-Challenge and Challenge messages, SAFE/DISARM, ARM, and FIRE command messages, verification messages. Italicized portions of the message format identify ciphertext (encrypted data blocks in hexadecimal format).

TABLE II

| ACTION | MSG ID | MESSAGE FORMAT | DESCRIPTION |
|---|---|---|---|
| ❶ Integration of digital code plug 40 in communicative combination with the firing circuit 20 | | @0K | Status Message - see paragraphs (a), (b), and (c) |
| ❷ Removal of the digital code plug 40 from communicative combination with the firing circuit 20 | | @0k | Status Message - see paragraphs (a), (b), and (c) |
| ❸ Integration of digital code plug 40 in communicative combination with the firing control panel 30 | | $0K | See paragraphs (a), (b), and (c) |
| ❹ Removal of the digital code plug 40 from communicative combination with the digital firing circuit 20 | | $0K | See paragraphs (a), (b), and (c) |
| ❺ Integration of digital code plug 40 in communicative combination with the firing control panel 30 (or actuation of the link-test mechanism 33 or deactuation of the arming mechanism 34) | M3 | $0S*FEDCBA9876543210* | See paragraphs (i), (j), (k), and (m) |
| Validation of the SAFE/DISARM command message M3 | M4 | @0VS*FEDC* | See paragraphs (i), (j), (k), and (m) |
| ❻ Actuation of the arming mechanism 34 | M1 | $0R*FEDCBA9876543210* | See paragraphs (i), (j), (l), (m), and (o) |
| Response to a Request-for-Challenge message M1 | M2 | @0C*FEDCBA9876543210* | See paragraphs (i), (j), (l), (m), (n), and (o) |
| Validation of the Challenge message M2 - automatic transmittal of the ARM command message | M5 | $0A*FEDCBA9876543210* | See paragraphs (i), (j), (m), (n), and (o) |
| Validation of the ARM command message M5 - firing circuit 20 transitioned to the armed state | M6 | @0VA*FEDC* | See paragraphs (i), (j), (n), and (o) |
| ❼ Actuation of the firing mechanism 35 | M1 | $0R*FEDCBA9876543210* | See paragraphs (i), (j), (l), (m), and (o) |
| Response to a Request-for-Challenge message M1 | M2 | @0C*FEDCBA9876543210* | See paragraphs (i), (j), (l), (m), (n), and (o) |
| Validation of the Challenge message M2 - automatic transmittal of the FIRE command message | M7 | $0F*FEDCBA9876543210* | See paragraphs (i), (j), (m), (n), and (o) |
| Validation of the FIRE command message M7 - firing circuit 20 activated (fired) | M8 | @0VF*FEDC* | See paragraphs (i), (j), (n), and (o) |

Figure 3:
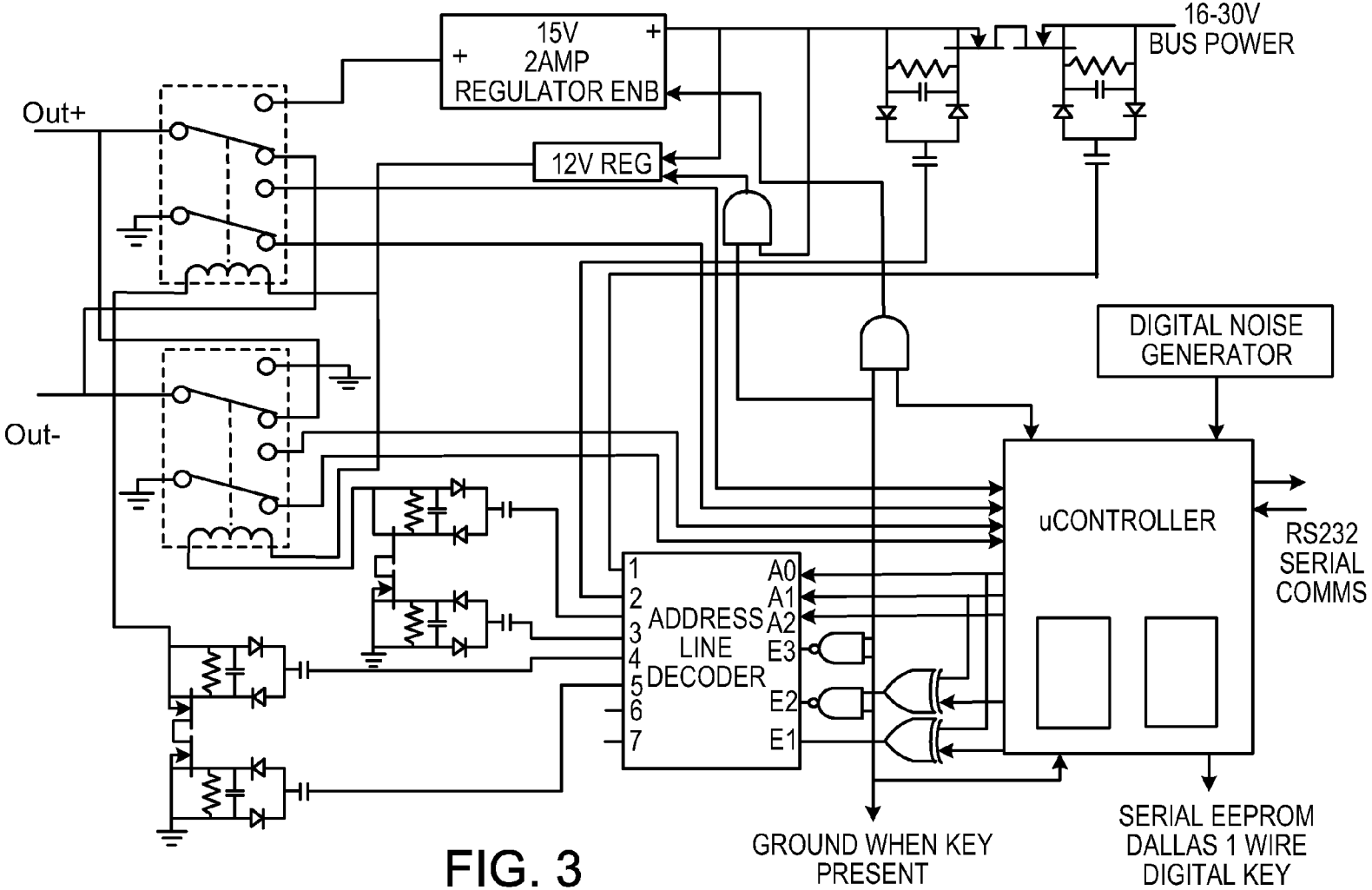
FIG. 3 is a preferred embodiment of a schematic of the firing circuit for the remote digital firing system of the present invention.

FIG. 3 illustrates a preferred embodiment of a schematic of the firing circuit 20 for the remote digital firing system 10 according to the present invention. The firing circuit 20 includes, in addition to the microcontroller 21, the modifiable, read-only memory module 22, the application module 23, and the hardware random noise generator 24 described above, a conventional input/output interface 21I/O, e.g., a 9600 baud RS232 link, for communications with the firing control panel 30 (via serial link L2, the portable control console PCC, the external link LP, vehicle RCV, and serial link L1 for the described embodiment), a proprietary Dallas 1-wire interface 21$O_{40}$ for writing the one-time random encryption key and session codes to the digital code key 40 when the digital code plug 40 is integrated in communicative combination with the firing circuit 20, an address line decoder chip 26, an output regulator 27, a power bus 28PB, an arming stage 28A, first and second firing stages 28F1, 28F2, first and second output relays 28OR1, 28OR2, and dual output lines 28DO.

The decoder 26 includes input lines 26IL (address and enable) from the microcontroller 21 and output lines L00-L05 connected to the arming stage 28A (lines L00, L01), the first firing stage 28F1 (lines L02, L03) and the second firing stage 28F2 (lines L04, L05). The decoder 26 is operative, in response to a signal transmitted by the microcontroller 21, to selectively enable one of these output lines for transmission of a narrow band pulsed signal. The decoder 26 depicted in FIG. 2 is a 3-to-8 line decoder such that the microcontroller 21 can only access one branch of any stage 28A, 28F1, or 28F2 at a time, thereby substantially reducing the potential for randomly accessing these stages 28A, 28F1, or 28F2. To further negate the possibility of random access, the three address input lines and two of the enable lines of the 3-to-8 line decoder 26 are crossed with XOR gates, requiring two other output ports of the microcontroller 21 to be coordinated before any output line of the 3-to-8 line decoder 26 can be enabled.

The microcontroller 21 is operative, in response to the ARM command message, to transmit two sequential signals (3-bit address, enable) to the 3-to-8 line decoder 26, which is operative in response to such signals to transmit narrow band pulsed signals on the sequentially enabled output lines L00 and L01 to enable the arming stage 28A. In a similar manner, the microcontroller 21 is operative in response to the FIRE command message to sequentially transmit six sequential signals (3-bit address, enable) to the 3-to-8 line decoder 26, which is operative in response to such signals to transmit narrow band pulsed signals on the sequentially enabled output lines L00-L05 to enable the first and second firing stages 28F1, 28F2 as well as the arming stage 28A. The microcontroller 21 is also operative, in response to the Safe/Disarm command message, to transmit a signal (enable) to disable all output lines L00-L05 of the 3-to-8 line decoder 26, thereby disabling the arming stage 28A and the firing stages 28F1, 28F2, and de-energizing the output relays 28OR1, 28OR2.

The output regulator 27 is electrically connected to one side of the arming stage 28A and to one terminal of the first output relay 28OR1. The output regulator 27 is configured, and operative in response to an enable signal from the microcontroller 21, to produce an output of no more than 15 volts and no more than 2 amps for approximately 300 msec (actual output voltage and current will depend on the output load).

The arming stage 28A and first and second firing stages 28F1, 28F2 are operative in enabled combination to complete the electrical circuit between the power bus 28PB and the dual output lines 28DO of the firing circuit 20. Enabling of the arming stage 28A completes the electrical circuit between the power bus 28PB and the output regulator 27. Enabling the first and second firing circuits 28F1, 28F2 energizes the first and second output relays 28OR1, 28OR2, respectively, to complete the electrical circuit between the output regulator 27 and the dual output lines 28DO.

Figure 3A:
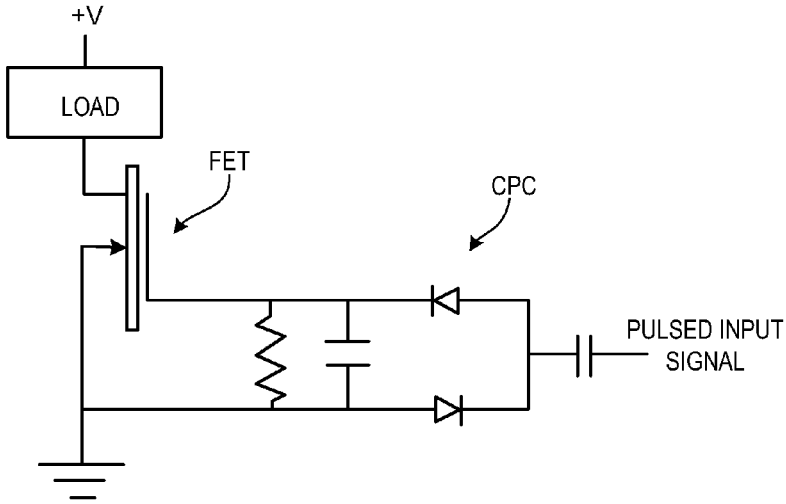
FIG. 3A illustrates an exemplary pumped capacitor field effect transistor driver of the type utilized in the preferred firing circuit embodiment depicted in FIG. 3.

The arming stage 28A and the first and second firing stage 28F1, 28F2 of the described embodiment each comprise a pair of serialized field effect transistors (FETs), with the operation of each FET being regulated by a dedicated capacitive pumping subcircuit (see FIG. 3A which illustrates an FET enabled by a capacitive pumping subcircuit CPC). The FET pair of each stage 28A, 28F1, 28F2 are of different types, i.e., an N type and a P type, each FET type having a different failure mode to increase the reliability of the arming and firing subcircuits 28A, 28F1, 28F2. The dedicated capacitive pumping subcircuits of the arming stage 28A and firing stage 28F1, 28F2 are coupled to (via output lines L00-L05, respectively) and configured for operation only in response to narrow band pulsed signals from the decoder chip 26, which effectively eliminates the possibility of any spurious signals enabling any of the stages 28A, 28F1, 28F2.

The output relays 28OR1, 28OR2 of the described embodiment are operative, when energized, to complete the circuit between the output regulator 27 and the dual output lines 28DO. For the described embodiment, the output relays 28OR1, 28OR2 are from the NAIS TX series, rated for 2 amps switching at 30 volts. The output relays 28OR1, 28OR2 have a balanced mechanism that moves about an axis parallel to the firing circuit 20 PC board and are highly resistant to shock effects (75 G malfunction rating). The output relays 28OR1, 28OR2 are mounted at different orientations relative to one another so that a single shock event is unlikely to trigger both output relays 28OR1, 28OR2. The rated life of such relays is approximately 100,000 cycles at 2 amps switching, but since the output relays 28OR1, 28OR2 are not used to switch current, their operational life should be significantly greater.

The dual output lines 28DO of the first and second output relays 28OR1, 28OR2 are shorted together until both output relays 28OR1, 28OR2 are closed (enabled). This configuration allows a system operator to verify the functionality of the firing circuit 20 before attaching a munition, and keeps the dual output lines 28DO in a shorted state to eliminate any adverse effects on the firing circuit 20 in the event of a failure of one of the first and second output relays 28OR1, 28OR2.

In addition to the foregoing features, the firing circuit 20 depicted in FIG. 3 also includes signal lines s1, s2 that provide unambiguous arm relay position feedback for the output relays 28OR1, 28OR2 to the microcontroller 21. Further, the logic gates associated with the address line decoder 26, and a logic gate lg, are operative when the digital code plug 40 is integrated in communicative combination with the firing circuit 20, to disable the output regulator 27 and the address line decoder 26, thereby electronically disabling the output relays 28OR1, 28OR2 and the arming stage 28A since none of the dedicated capacitive subcircuits can receive the narrow band pulsed signals that activate the FETs (see discussion above in connection with the paragraph (3) function of the microcontroller 21).

The normal operational sequence of the firing circuit 20 described above is as follows. In response to a validated ARM command message, the arming subcircuit 28 is enabled to complete the electrical circuit between the output regulator 27 and the power bus 28PB. In response to a validated, timely FIRE command message, the firing stages 28F1, 28F2 are enabled, which energizes the output relays 28OR1, 28OR2 to complete the electrical circuit between the output regulator 27 and the dual output lines 28DO.

After the output relays 28OR1, 28OR2 are energized, the microcontroller 21 transmits an enable signal to the output regulator 27, which allows current to flow through the circuit path provided by the dual output lines 280D. This sequencing ensures that the output relays 28OR1, 28OR2 are not subjected to arcing during energization, i.e., the soft switch effect. The foregoing sequence is reversed when the dual output lines 280D are disabled to eliminate arcing when the output relays 28OR1, 28OR2 are de-energized.

Figure 4:
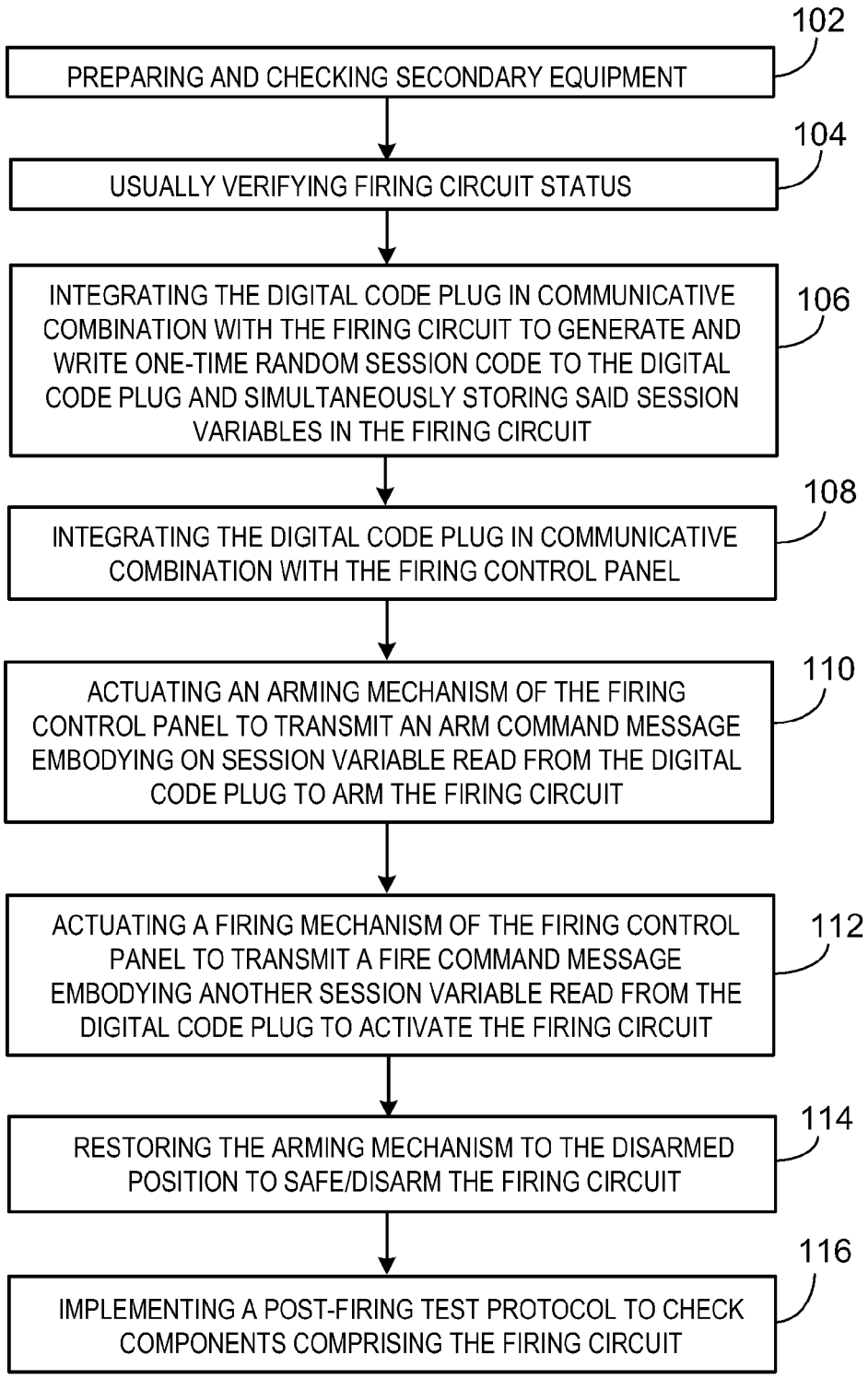
FIG. 4 is a flow diagram illustrating a nominal operating method for the remote digital firing system of the present invention.

A nominal operating method 100 for the described embodiment of the remote digital firing system 10 according to the present invention is exemplarily illustrated in FIG. 4. A first step 102 is implemented to prepare and check the secondary equipment for the mission. For example, the primary serial communications link LP between the vehicle RCV and the portable control console PCC is activated and tested, the deployment mechanism of the vehicle RCV is moved to the payload loading position (payload manipulator is clear of the vehicle RCV and accessible to a system operator), the vehicle RCV brakes are set.

Next, in a step 104 the system operator verifies the status of the firing circuit 20 by a visual examination of the indicator lights 25 of the firing circuit 20. At this juncture, the green indicator light 25B should be illuminated, indicating that the firing circuit 20 is in the disarmed (safe) state. A flashing red indicator light 25A at this step indicates the presence of a system fault and that the remote digital firing system 10 is inoperable. For the described embodiment, 'flashing' denotes a 50% duty cycle at 4 Hz.

In step 106, the digital code plug 40 is integrated in communicative combination with the firing circuit 20. The green indicator light 25 will temporarily cycle off and then illuminate steadily to indicate successful integration of the digital code plug 40 with the firing circuit 20. In response to this action, the firing circuit 20 is automatically operative to generate the key-inserted status message—see first row of Table II and paragraphs (a)-(c) of the prescribed communication protocol. A flickering red indicator light 25A at this step 106 indicates a bad digital code plug 40 or a poor connection. For the described embodiment, 'flickering' denotes a 12% duty cycle at 4 Hz. Encountering a flickering red indicator light 25A at this step 106 causes the method 100 to be exited.

Two functions are accomplished in step 106. First, the digital code plug 40 electronically disables the firing circuit 20, thereby precluding inadvertent or intentional operation of the firing circuit 20 (the relevant instruction sets of the firing circuit 20 provide a backup capability that precludes inadvertent or intentional operation of the firing circuit at this step). Second, a set of one-time random session variables and the rolling code sequence are automatically written to the digital code plug 40 and simultaneously to the memory module 22 of the firing circuit.

As part of step 106, the system operator attaches the mission payload PL to the payload manipulator of the vehicle RCV. Once the mission payload PL attachment process is completed, the system operator completes step 106 by removing the digital code plug 40 from communicative combination with the firing circuit 20. In response to this action, the firing circuit 20 is automatically operative to generate the key-removed status message—see second row of Table II and paragraphs (a)-(c) of the prescribed communication protocol.

In step 108, the digital code plug 40 is integrated in communicative combination with the firing control panel 30. This action causes the firing control panel 30 to: (i) generate the key-inserted status message—see third row of Table II and paragraphs (a)-(c) of the prescribed communication protocol in a substep 108A; and implement the link test, i.e., generate the Safe/Disarm command message M3, with the firing circuit 20—see row three of Table II and paragraphs (a), (d), (i), (j), (k), (m) and (o) of the prescribed communication protocol—to verify communications integrity between the firing control panel 30 and the firing circuit 20 in a substep 108B. The firing circuit 20 is operative, in response to the Safe/Disarm command message M3, to implement the validation protocol with respect to such command message M3—see paragraphs (k), (m) and o) of the prescribed communication protocol in a substep 108C. If the Safe/Disarm command message M3 is validated, the firing circuit 20 is operative to: (1) verify that the firing circuit 20 is in the disarmed (safed) state; and to automatically generate the verification message M4—see row four of Table II and paragraphs (a), (i), (j), and (o) of the prescribed communication protocol in a substep 108D. If the Safe/Disarm command message M3 is not validated, the remote digital firing system 10 returns to the end of step 106 (a new digital code plug 40 must be inserted) or prior to step 108A (the system operator must actuate the link-test mechanism 33 to generate another Safe/Disarm command message M3—see paragraph (p) of the prescribed communication protocol.

At this point, the vehicle RCV is driven to the area of operations and the mission payload PL is positioned using the deployment mechanism and/or the payload manipulator of the vehicle RCV. Once the mission payload PL has been properly positioned, the mission payload PL can be activated by performing steps 110 and 112 as described below.

In step 110, the system operator actuates the arming mechanism 34 of the firing control panel 30 to arm the firing circuit 20. Arming of the firing circuit 20 requires the implementation of several substeps as follows. In substep 110A, the firing control panel 30 is automatically operative, in response to actuation of the arming mechanism 34, to generate and transmit a Request for Challenge message M1—see row seven of Table II and paragraphs (a), (f), (j), (l), and (o) of the prescribed communication protocol—to the firing circuit 20. In substep 110B the firing circuit 20 is automatically operative, in response to message M1, to generate and transmit a Challenge message M2 to the firing control panel 30—see row eight of Table II and paragraphs (a), (i), (j), (l), and (o) of the prescribed communication protocol—to the firing control panel 30.

In response to the Challenge message M2, the firing control panel 30 is operative in substep 110C to verify panel status and compliance with the prescribed communication protocol constraints. More specifically, the firing control panel 30 is operative to: (i) verify that the arming mechanism 34 is still in the armed position; and (ii) ensure that the Challenge message M2 was received within the established validity window—see paragraph (n) of the prescribed communication protocol. In step 110D the firing control panel 30 is operative to automatically generate and transmit the Arm command message M5—see row nine of Table II and paragraphs (a), (i), (j), (l), and (o) of the prescribed communication protocol—to the firing circuit 20. Upon receipt of the Arm command message M5, the firing circuit is operative in substep 110E to: (i) ensure the Arm command message M5 was received within the established validity window—see paragraph (n) of the prescribed communication protocol; and (ii) implement the validation protocol with respect the Arm command message M5—see paragraph (m) of the prescribed communication protocol. If the Arm command message M5 was received within the established validity window and valid, the firing circuit 20 is armed in substep 110F and the firing circuit 20 automatically transmits a verification message M6—see row ten of Table II and paragraphs (a), (i), (j), and (o)—to the firing control panel 30. Finally in substep 110G, the firing circuit 20 and the firing control panel 30 are operative to extinguish the green indicator lights 25B, 36B, respectively, and to illuminate the red indicator lights 25A, 36A, respectively, to provide visual indications that the firing circuit 20 is in the armed state.

In step 112, the system operator actuates the firing mechanism 35 of the firing control panel 30 to activate (fire) the firing circuit 20 to fire the remote mission payload PL. Firing of the firing circuit 20 requires the implementation of several substeps as follows. In substep 112A, the firing control panel 30 is automatically operative, in response to actuation of the firing mechanism 35, to generate and transmit a Request for Challenge message M1—see row eleven of Table II and paragraphs (a), (i), (j), (l), and (o) of the prescribed communication protocol—to the firing circuit 20. In step 112B the firing circuit 20 is automatically operative, in response to message M1, to generate and transmit a Challenge message M2 to the firing control panel 30—see row twelve of Table II and paragraphs (a), (i), (j), (l), and (o) of the prescribed communication protocol—to the firing control panel 30.

In response to the Challenge message M2, the firing control panel 30 is operative in step 112C to verify panel status and compliance with the prescribed communication protocol constraints. More specifically, the firing control panel 30 is operative to: (i) verify that the firing mechanism 35 is still in the activated position; and (ii) ensure that the Challenge message M2 was received within the established validity window—see paragraph (n) of the prescribed communication protocol. In step 112D the firing control panel 30 is operative to automatically generate and transmit the FIRE command message M7—see row thirteen of Table II and paragraphs (a), (i), (j), (l), and (o) of the prescribed communication protocol—to the firing circuit 20. Upon receipt of the FIRE command message M7, the firing circuit is operative in step 112E to: (i) ensure the FIRE command message M7 was received within the established validity window—see paragraph (n) of the prescribed communication protocol; and (ii) implement the validation protocol with respect the received FIRE command message M7—see paragraph (m) of the prescribed communication protocol. If the FIRE command message M7 was received within the established validity window and valid, the firing circuit 20 is activated (fired) in step 112F and the firing circuit 20 automatically transmits a verification message M14—see row fourteen of Table II and paragraphs (a), (i), (j), and (o)—to the firing control panel 30. As discussed above in connection with specifics described for the firing circuit 20 depicted in FIG. 3 the firing circuit 20 is activated in a "soft switch" fashion, i.e., the output relays 28OR1, 28OR2 are enabled prior to the enablement of the output regulator 27 to preclude arcing of the output relays 28OR1, 28OR2. In step 112G, the firing control panel 30 is operative, in response to the verification message M14, to illuminate the red indicator light 36A on the firing control panel 30 in a flashing mode to alert the system operator to restore the arming mechanism 34 to the disarmed (safed) position.

In step 114 the arming mechanism 34 is manipulated to restore the arming mechanism 34 to the disarmed (safed) position. The firing control panel 30 is operative, in response to restoration of the arming mechanism 34 to the disarmed (safed) position, to generate and transmit a generate the SAFE/DISARM command message M3, to the firing circuit 20—see row five of Table II and paragraphs (a), (h), (i), (j), (k), (m) and (o) of the prescribed communication protocol. Receipt of the SAFE/DISARM command message M3 causes the firing circuit 20 to disable the firing circuit 20 and to transmit the verification message M4—see row six of Table II and paragraphs (a), (i), (j), and (o) of the prescribed communication protocol—to the firing control panel 30. Upon receipt of the verification message M4, the firing control panel 30 is operative to extinguish the flashing red indicator light 36A and steadily illuminate the green indicator light 36B to indicate that the firing circuit 20 is disarmed.

Finally, in step 116 the firing circuit 20 is operative to implement a post-firing test protocol to ensure the continued operability of the components comprising the firing circuit 20 described above in connection with FIG. 3.

For the described embodiment wherein the firing circuit 20 is integrated in combination with the vehicle RCV and the firing control panel 30 is integrated in combination with the portable control console PCC, the vehicle RCV and the portable control console PCC each include a microprocessor that is an element of the corresponding serial link L1 or L2 for the remote digital firing circuit 10. These microprocessors, accordingly, function as serial pass throughs for all message traffic between the firing control panel 30 and the firing circuit 20. In view of this characteristic of the microprocessors of the vehicle RCV and the portable control console PCC, these microprocessors can be functionally configured, e.g., by software, firmware, hardware, or combinations thereof, to be operative, under specified conditions, to inhibit the transmission of ARM and FIRE command messages from the firing control panel 30 to the firing circuit 20.

Figure 5:
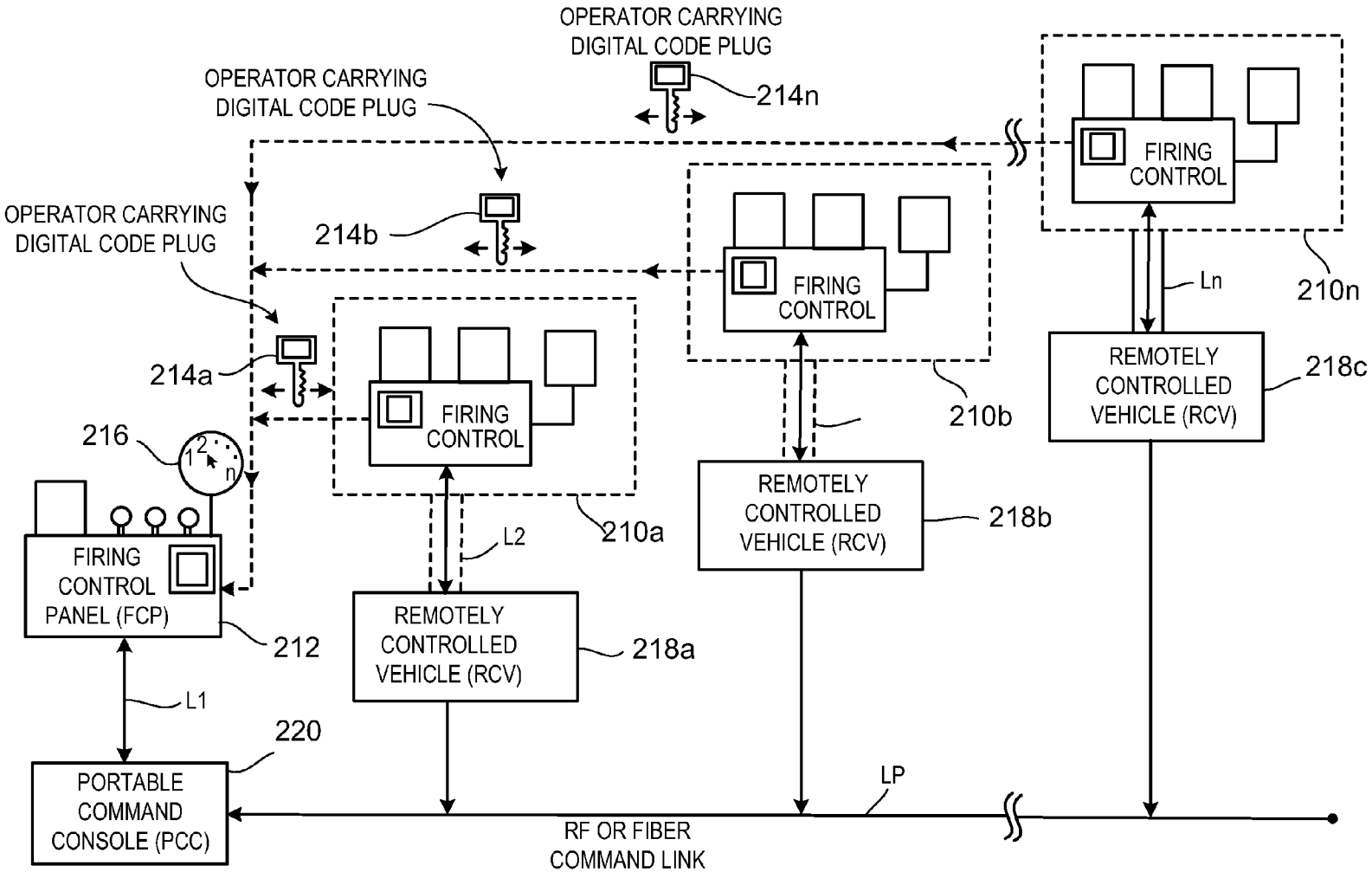
FIGS. 5-8 are schematic views of exemplary remote digital firing systems.

Referring to FIG. 5, and in another aspect, a remote digital firing system 200 is designed to allow the control of multiple firing circuits 210*a*-210*n*. The remote digital firing system 200 comprises firing circuits 210*a*-210*n*, a firing control panel 212, and digital code plugs 214*a*-214*n*. In one embodiment, each digital code plug 214 carries one-time random session variables for a single firing circuit 210 to firing control panel 214.

Similar to the previously described embodiment, each firing circuit 210 and the firing control panel 212 are integrated in combination with secondary equipment. Each firing circuits 210 and the firing control panel 212 are serially linked for communication by links L1-Ln and LP. L1-Ln are internal links between the firing circuits and the firing control panel 30 and the respective secondary equipment and LP is an external link between such secondary equipment. The external link LP can pass through multiple computers, radio systems, optical tethers, and/or combinations thereof. As with other embodiments described herein, the primary serial communication link LP can be shared with other applications, e.g., an insecure radio communications links for control a mobile robot, without risk that signals from such applications will adversely impact the operation of the firing system 200.

Firing control panel 212 includes a weapon selector switch 216 for selecting which firing circuit 210 will be controlled. In one embodiment, firing control panel could include a display showing the name of the selected weapon. This would help a user unambiguously know which weapon and firing circuit are selected for operation by control panel 212. The display could also show informational messages, as described herein.

In one example, system 200 is designed to allow the control of up to 16 different firing circuits, identified with a hexadecimal digit from "0" to "9" and "a" through "f". But those skilled in the art will understand that control of more firing circuits is possible using system 200 as described in more detail, below.

All messages that originate from firing circuit 210 start with the "@" character as a mark. A hexadecimal routing digit that identifies the originating firing circuit follows the mark character. Non-routed messages, such as informational messages sent to the local host (e.g., remotely controlled vehicle 218) use "L" as the routing identifier. The message terminates with the <0x0a> line feed character and will not exceed 40 characters in length.

All messages that originate from the firing control panel 212 start with the "$" character. A hexadecimal routing digit that identifies which firing circuit the message is intended for follows this mark character. Non-routed messages, such as informational messages sent to the local host (e.g., portable command console 220) use "L" as the routing identifier. The message is terminated with the <0x0a> line feed character and will not exceed 40 characters in length.

As described in above embodiments, encryption is performed with the XTEA algorithm, which is an extension of the Tiny Encryption Algorithm. Firing control panel 212 contains the algorithm for encrypting. Firing circuits 210 contain the algorithm for decrypting. Neither circuit contains the opposite routine. However, since encryption is symmetric, a message can be "encrypted" by giving the original clear text message to the decryption routine, which will generate a scrambled set of bits which can be descrambled with the encryption routine. While this makes for confusing descriptions, it offers several benefits. Code size is reduced since each microcontroller needs only one half of the algorithms. When a code is read from digital code plug 214 directly into an encryption buffer, once scrambled it cannot be reconstructed since the decryption algorithm does not exist on that processor. This guarantees that once digital code plug 214 is removed, appropriate challenge responses cannot be generated.

Commands from Control Panel to Firing Circuit

Examples of commands from control panel 212 to firing circuits 210 are shown in Table III and described below.

TABLE III

| Commands from Control Panel to Firing Circuit | |
|---|---|
| Safe (disarm) command | 8 bit protocol version (4) |
| | 8 bit command character ("S") |
| | 8 bit packet sequence lower byte (random on plug insertion) |
| | 8 bit packet sequence upper byte (zeroed on plug insertion) |
| | 32 bit safe code ("SAFE") |
| Status Request (Heartbeat) Command | 8 bit protocol version (4) |
| | 8 bit command character ("H") |
| | 16 bit packet sequence number |
| | 16 bit heartbeat code ("HB") |
| | 16 bit random pad |
| Arm Command | 8 bit protocol version (4) |
| | 8 bit command character ("A") |
| | 16 bit command challenge (from most recent status) |
| | 32 bit Arm code read from code plug |
| Fire Command | 8 bit protocol version (4) |
| | 8 bit command character ("F") |
| | 16 bit command challenge (from most recent status) |
| | 32 bit Fire code read from code plug |

Safe (Disarm) Command

A Safe (disarm) command is formed by first creating a 64 bit data block as shown in Table III. The packet sequence is then incremented and preserved in volatile RAM. The packet sequence number is a 16 bit integer that is assigned a random value for 0 to 255 whenever a code plug is inserted or when power to the firing control panel is cycled. The 64 bit data block is then encrypted, and a message is transmitted in the form:

$0xxxxxxxxxxxxxxxxx<0x0a> where "$" is a mark character which starts all commands sent from the firing control panel to the firing circuit, "0" is the target system identifier. The remaining sixteen characters are the encrypted 64 bit block in hexadecimal format, two characters per byte, lowest order byte first.

Firing circuit 210 receives the Safe command and decrypts the 64 bit data block. The firing circuit 210 then verifies the protocol version number, the command character, and the 32 bit safe code (which is the string "SAFE"). The sequence number is preserved for formulating a response. The firing circuit 210 will respond to the Safe command with a Status Response packet, described below.

Status Request (Heartbeat) Command

Periodically, at a random interval between 1 second and 5 seconds, the Firing Control Panel 212 will generate a heartbeat status request to confirm the system status. The Status Request command is formed by first creating a 64 bit data block shown in Table III The packet sequence is then incremented and preserved in volatile RAM. The 64 bit data block is then encrypted, and a message is transmitted in the form:

$0xxxxxxxxxxxxxxxxx<0x0a> where "$" is a mark character which starts all commands sent from the firing control panel to the firing circuit, "0" is the target system identifier. The remaining sixteen characters are the encrypted 64 bit block in hexadecimal format, two characters per byte, lowest order byte first. The firing circuit 210 responds to the Heartbeat Status request with the Status Response described below.

The 16 bit random pad is used to limit the amount of known text in the packets to frustrate cryptanalysis. The random time interval between heartbeat requests is intended to help mask activity from traffic analysis, so that a non-periodic event can not be transparently perceived as an "arm" or "fire" activity.

Arm Command

When switch 216 is moved to the "Arm" position, an arm command is composed by first creating a 64 bit data block shown in Table III. This data block is then encrypted, and a message is transmitted of the form:

$0xxxxxxxxxxxxxxxxx<0x0a> where "$" is a mark character, "0" is the target system identifier. The remaining sixteen characters are the encrypted 64 bit block in hexadecimal format.

The firing circuit 210 decrypts the command and verifies all 64 bits of the decrypted data packet. The command challenge must match either the most recently sent challenge or the second most recently sent challenge in a status packet. The arm code is verified against the copy stored in the firing circuit 210 when the code plug 214 was in plugged into firing circuit 210. If all the data is verified, firing circuit 210 is transitioned to the armed state and a status response packet is sent. The status response packet is formed using the most recent packet sequence number from a status request or safe command, since the arm command does not contain an updated packet sequence number.

Fire Command

When the fire switch is depressed after the arm switch, a fire command is composed by first creating a 64 bit data block shown in Table III. This data block is then encrypted, and a message is transmitted of the form:

$0xxxxxxxxxxxxxxxxx<0x0a> where "$" is a mark character, "0" is the target system identifier. The remaining sixteen characters are the encrypted 64 bit block in hexadecimal format.

The firing circuit 210 decrypts the command and verifies all 64 bits of the decrypted data packet. The command challenge must match either the most recently sent challenge or the second most recently sent challenge in a status packet. The fire code is verified against the copy stored in firing circuit 210. If all the data is verified, the circuit outputs are energized and a status response packet is sent when the firing pulse completes. The status response packet is formed using the most recent packet sequence number form a status request or safe command, since the arm command does not contain an updated packet sequence number.

Responses from Firing Circuit to Control Panel

Examples of responses from firing circuits 210 to control panel 212 are shown in Table IV and described below.

TABLE IV

| Responses from Firing Circuit to Control Panel | |
|---|---|
| Status (heartbeat) Response | 8 bit protocol version (4) |
| | 8 bit status character ("S" safe, "A" armed, "s" safe error, "e" fatal error) |
| | 16 bit count of the number of times the system has been fired since manufacture |
| | 16 bit packet sequence number (from the last command) |
| | 16 bit randomly generated command challenge |
| Information Message | 8 bit protocol version (4) |
| | 8 bit status character ("I") |

TABLE IV-continued

| Responses from Firing Circuit to Control Panel |
|---|
| 8 bit release number (minor version) |
| 8 bit version number (major version) |
| 8 bit error code path record (zero if no error) |
| 8 bit error master mode record |
| 16 bit error test record (identifies which HW components are suspect) |

Status (Heartbeat) Response

If a Safe command or Status Request is verified, a status response is generated by first creating a 64 bit data block as shown in Table IV. The 64 bit data block is then encrypted (by decrypting), and a message is transmitted in the form:

@0xxxxxxxxxxxxxxxx<0x0a> where "@" is a mark character which starts all commands sent from the firing circuit 210 to the firing control panel 212, "0" is the originating system identifier. The remaining sixteen characters are the encrypted 64 bit block in hexadecimal format, two characters per byte, lowest order byte first.

When this status block is received by the firing control panel 212, it is decrypted (by encrypting) and the version and sequence numbers are verified, then red and green LEDs on the firing control panel 212 are illuminated to confirm that the link is sound and to reflect the status of firing circuit 210. Otherwise a red LED flashes indicating a failed communication link. The command challenge is preserved to form arm and fire commands as needed.

Information Message

In response to a Safe command, the firing circuit 210 responds with first a Status Response and then an Information Message. An Information Message is generated by first creating a 64 bit data block as shown in Table IV. The 64 bit data block is then encrypted (by decrypting, see below), and a message is transmitted in the form:

@0xxxxxxxxxxxxxxxx<0x0a> where "@" is a mark character which starts all commands sent from the firing circuit 210 to the firing control panel 212, "0" is the originating system identifier. The remaining sixteen characters are the encrypted 64 bit block in hexadecimal format, two characters per byte, lowest order byte first. When the firing control panel 212 receives an information message, it decodes it and generates a parsable local message to display to the user or record in a log.

Local Messages from Firing Circuit

The following are examples of local messages from firing circuit 210 to its host, for example remotely controlled vehicle 218.

Code Plug Insertion Message

When the digital code plug 214 is inserted into the firing circuit 210, the unit signals the remotely controlled vehicle 218 that a code plug has been inserted by transmitting the string:

@LK<0x0a> where "@" is a mark character which starts all strings from the firing circuit 210, "L" is the target system identifier (indicating a non-routed local message), and "K" implies a code plug insertion. The remotely controlled vehicle 218 can use this knowledge to prevent motor motion while the code plug 214 is inserted.

Then the following information is written into the code plug: an encryption key (128 bits randomly generated); an Arm code (32 bits randomly generated); a Fire code (32 bits randomly generated); and a Weapon name (8 bytes, e.g., "HEAD_0"). This data is also preserved in EEPROM on the firing circuit 210 with the exception of the weapon name.

Code Plug Removal Message

When the digital code plug 214 is removed from the firing circuit 210, the unit signals by transmitting the string:

@Lk<0x0a> where "@" is a mark character which starts all strings from the firing circuit 210, "L" is the target system identifier (indicating a non-routed local message), lower case "k" implies a code plug removal.

Informational Message

The firing circuit 210 on remotely controlled vehicle 218 will produce a message similar to the "Remote Informational message" from the firing control panel 212 after any disarm sequence. This message is of the form:

@LIVaa.bb,c,k,dddd,eeee,ffff<0x0a> where "$" is a mark character, "L" indicates that this is a local message not to be transmitted to a firing output, and the "V" indicates the type of informational string. The "aa.bb" designate the major and minor version numbers of the firmware (in hexadecimal) on a firing output circuit on the remotely controlled vehicle 218, the "c" is the system state ("S" for safe, lower case if in error mode, "A" for armed or firing), the "k" will be lower case if no digital code plug is inserted in the local system, or upper case "K" if a digital code plug is inserted in the local system, the "dddd" is the number of times (in hexadecimal) the circuit has been fired since manufacture, the "eeee" indicates which mode or code path lead to an error event (in hexadecimal, zero if no error), and the "ffff" is a hexadecimal string whose bits indicate which hardware tests caused the error condition. The below description of remote informational messages from firing control panel 212 goes into further detail.

The firing circuit 210 will also generate this message if queried with the string:

$0?

where "$" is a mark character, "0" targets the system in question, and "?" indicates a status query. A terminal <0x0a> is optional. In response to this command, the firing circuit 210 will produce the previously described Informational Message string, as well as an error debugging message string described below.

Error Debugging Message

The Error Debugging Message can be used to debug hardware problems. It is of the form:

@LIEaaaa,bbbb,cccc,dddd,eeee<0x0a> where "@" is a mark character, "L" indicates that this is a local message not to be transmitted to a firing output, and the "E" indicates the type of informational string. "aaaa" is a hexadecimal string whose bits indicate which hardware tests caused the error condition. "bbbb" is the hexadecimal data on the A and B ports of the PIC microcontroller at the time of the error, "cccc" is the number of times the error condition has been cleared from this firing circuit since manufacture. "dddd" is the current code plug signature, and "eeee" is a random system identification number generated the first time a code plug 214 is inserted that is used to track error reports.

Local Messages from Firing Control Panel

The following are examples of local messages from firing control panel 212 to its host, for example portable command console 220.

Code Plug Insertion Message

When the code plug 214 is inserted into the firing control panel 212, the unit signals that a code plug has been inserted by transmitting the string:

$LK<0x0a> where "$" is a mark character which starts all strings from the firing control panel 212, "L" is the selected system identifier (indicating a non-routed local message), "K" implies a code plug insertion.

Alternative Code Plug Insertion Message

When the code plug 214 is inserted the firing control panel 212 may also print out the string:

$LKssss<0x0a> where "$" is a mark character which starts all strings from the firing control panel 212, "L" is the selected system identifier (indicating a non-routed local message), "K" implies a code plug insertion, and "ssss" is the 16 bit session signature in hexadecimal. This session signature may be used to assert authority over the vehicle, for example.

Weapon Selection Message

If the firing control panel 212 is equipped with a weapon selector switch 216 and an LCD display, the unit will display the name of the selected weapon, helping the user unambiguously know which weapon has been selected. A local message is formed with the string:

$L0Nnnnnnnnn<0x0a>

Where "$" is a mark character which starts all strings from the firing control panel 212, "L" indicates a non-routable message for local use, "0" is the selected system identifier, "N" indicates a name string follows, and "nnnnnnnn" is the weapon name string. This string is transmitted whenever the code plug 214 is inserted, after the Code Plug Insertion Message.

Remote Informational Message

The firing control panel 212 decrypts the Information Message packet and generates a local message to reveal the status of the remote firing circuit 210. This message is of the form:

$LI0Vaa.bb,c,k,dddd,eeee,ffff<0x0a> where "$" is a mark character, "L" indicates that this is a local message not to be transmitted to a firing output, "0" indicates which firing circuit 210 is being described, and the "V" indicates the type of informational string. The "aa.bb" designate the major and minor version numbers of the firmware on the firing circuit 210 (in hexadecimal), the "c" is the system state ("S" for safe, lower case if in error mode, "A" for armed or firing), the "k" will be lower case if no key is inserted in the local system, or upper case "K" if a key is inserted in the local system, the "dddd" is the number of times the circuit has been fired since manufacture (in hexadecimal), the "eeee" indicates which mode or code path lead to an error event (in hexadecimal, zero if no error), and the "ffff" is a hexadecimal string whose bits indicate which hardware tests caused the error condition. They have no meaning if there is no error indicated in the "eeee" portion of the string. These bits are defined in Table VI:

TABLE VI

| Error Message Bits | |
|---|---|
| 0 | Arm FET Stage 0 test ("Arm0 test") |
| 1 | Arm FET Stage 1 test ("Arm1 test") |
| 2 | Positive Relay FET test ("FETposRly") |
| 3 | Negative Relay FET test ("FETnegRly") |
| 4 | Plug disable check ("SYS_EN") |
| 5 | Random number generator failure ("RNumGen") |
| 6-11 | Unused ("Undefined") |
| 12 | Positive relay normally closed sense ("RlyPosNC") |
| 13 | Negative relay normally closed sense ("RlyNegNC") |
| 14 | Positive relay normally open sense ("RlyPosNO") |
| 15 | Negative relay normally open sense ("RlyNegNO") |

The portable command console 220 may display this information to the operator to assist in the decision whether to continue operations at risk when a system hardware error is detected.

Local Informational Message

The firing control panel 212 will generate a local information message when requested by its host, portable command console 220 for example, with a command of the form:

@0?

Where "@" is a mark character, "?" indicates a query command. The firing control panel 212 generates a local message to reveal its the status. This message is of the form:

$LiVaa.bb,c,k,dddd,eeee<0x0a> where "$" is a mark character, "L" indicates that this is a local message not to be transmitted to a firing output, and the "V" indicates the type of informational string. The "aa.bb" designate the major and minor version numbers of the firmware on the firing control panel 212 (in hexadecimal), the "c" is the system, the "k" will be lower case if no key is inserted in the local system, or upper case "K" if a key is inserted in the local system, the "dddd" is the number of times the control panel has been used to initiate a firing sequence since manufacture (in hexadecimal), and the "eeee" is the power cycle count for the firing control panel (in hexadecimal).

Figure 6:
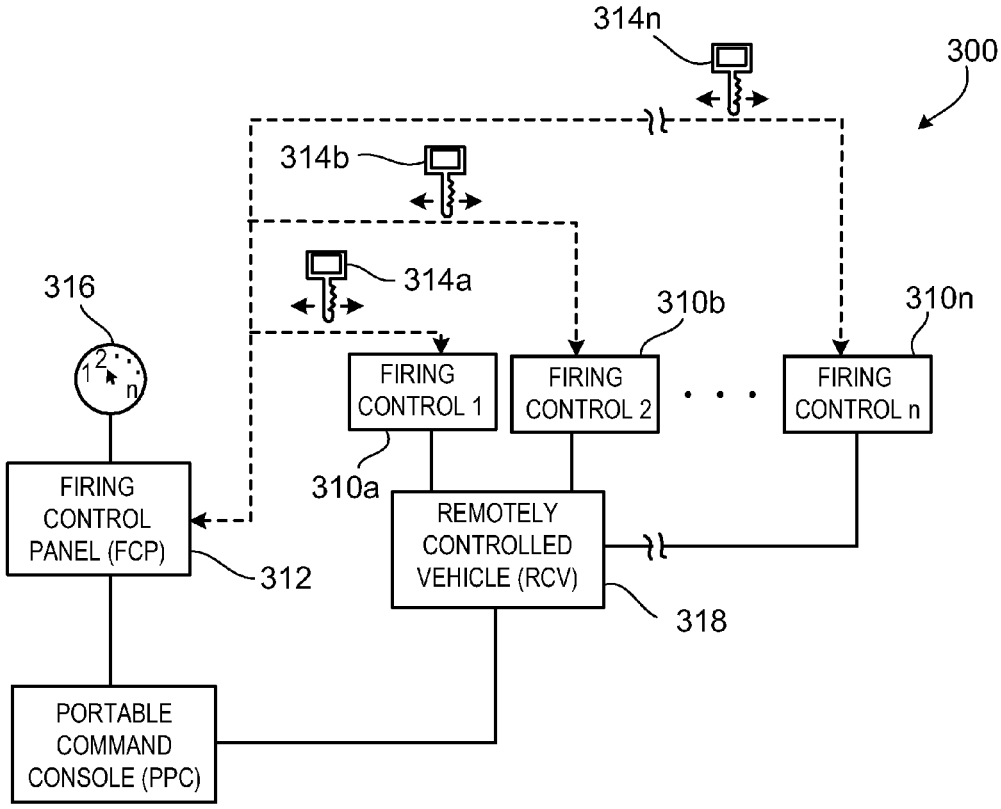

Referring to FIG. 6, and in another aspect, a remote digital firing system 300 is designed to control multiple firing circuits 310*a*-310*n* attached to a single remotely controlled vehicle 318. Each digital code plug 214 carries one-time random session variables for a single firing circuit 210 to firing control panel 214.

Figure 7:
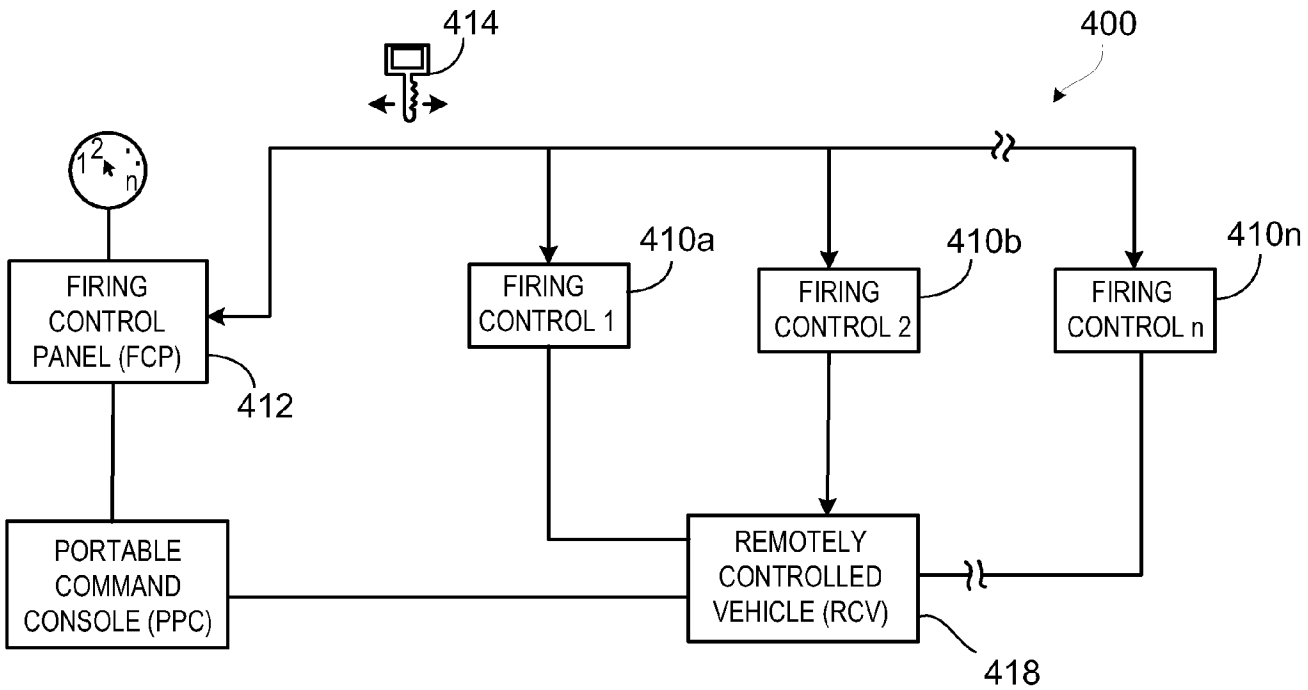
Figure 8:
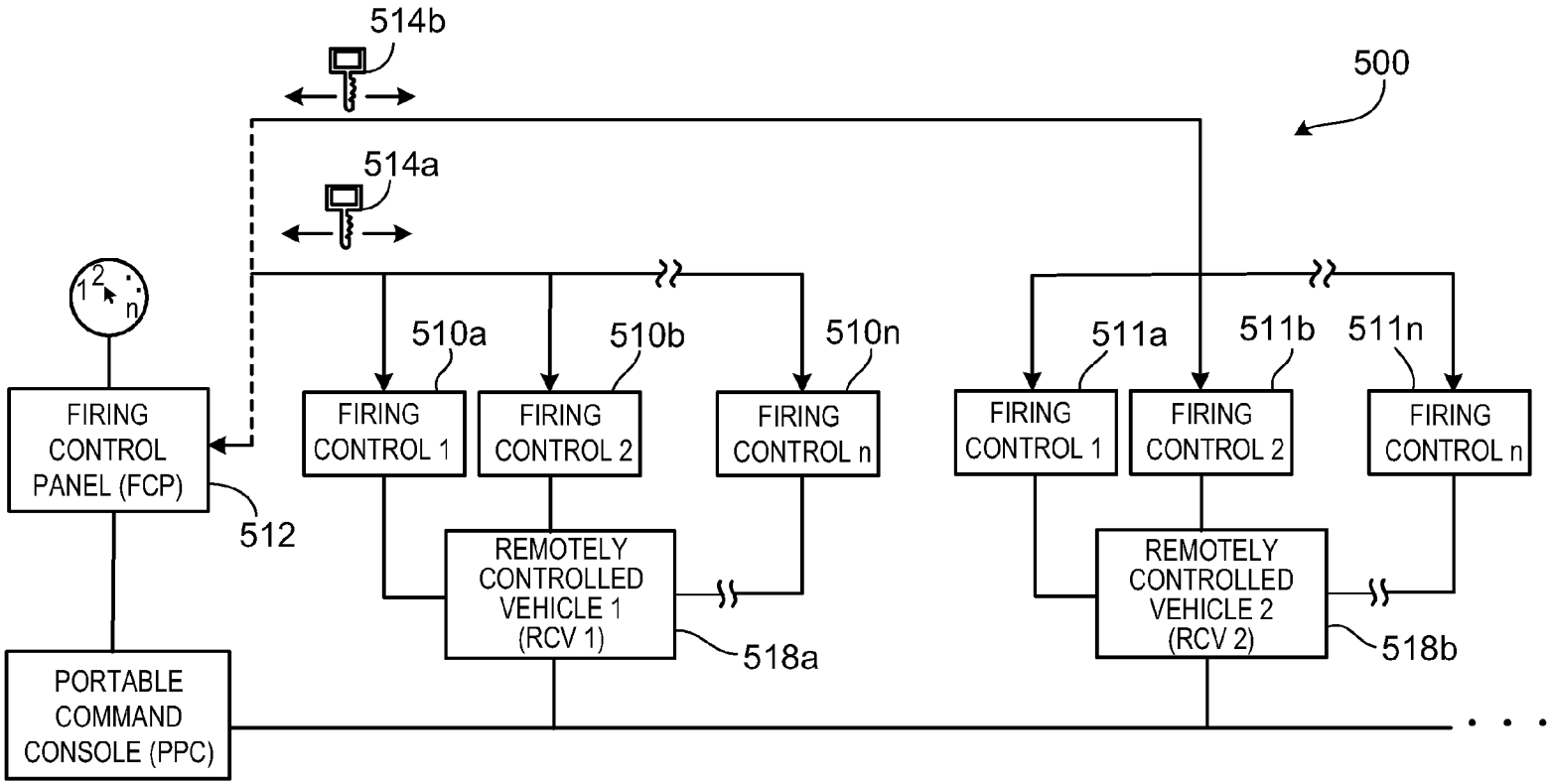

Referring to FIGS. 7 and 8, remote digital firing system 400 uses a single digital code plug 412 for storing one-time random session variables for each firing circuit 410, reducing the number of digital code plugs to one per remote controlled vehicle 418. Remote digital firing system 500 has two remotely controlled vehicles 518*a* and 518*b* having firing control circuits 510*a*-510*n* and 511*a*-511*n* mounted thereto, respectively. Digital code plug 514*a* carries one time session variables for firing control circuits 510 and digital code plug 514*b* carries one time session variables for firing control circuits 511. A single firing control panel 512 with the appropriate digital code plug operates each firing control circuit.

Figure 9A:
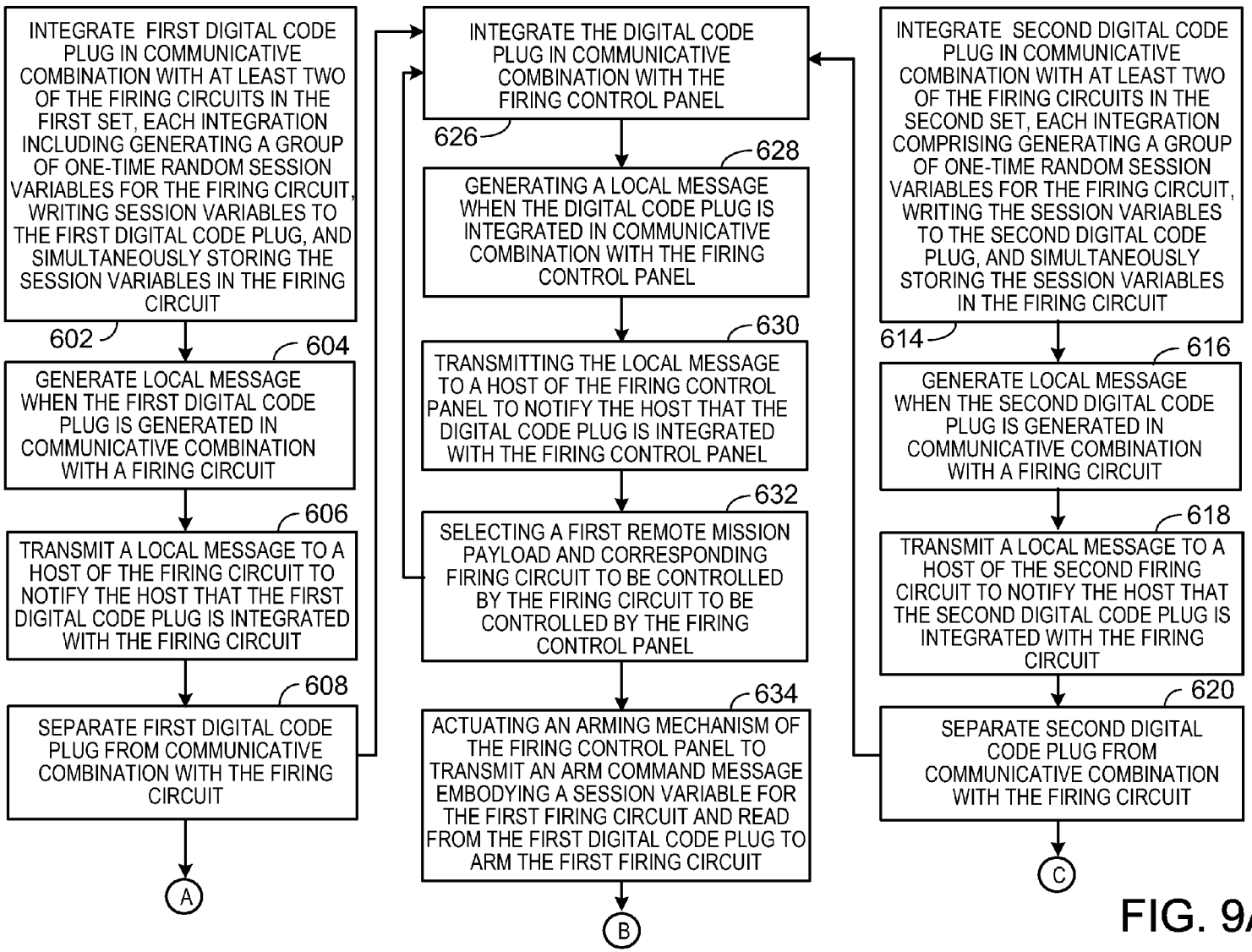
FIG. 9 is a flow chart providing an exemplary arrangement of operations for operating a remote digital firing system.
Figure 9B:
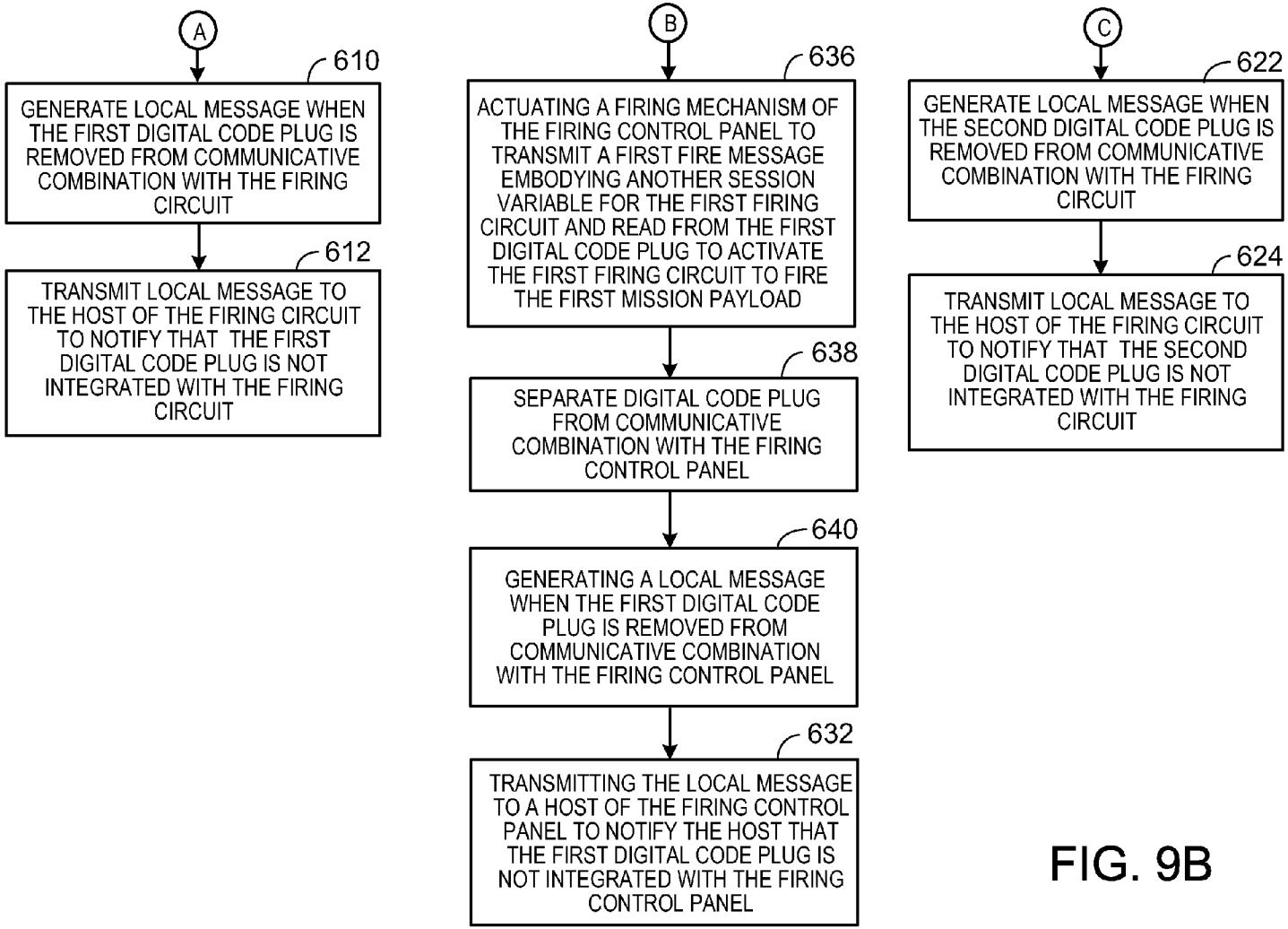

Referring to FIG. 9, and in another aspect, a method 600 of operating a remote digital firing system is shown. A first digital code plug is integrated at 602 in communicative combination with at least two of a first set of firing circuits. Each integration involves generating a group of one-time random session variables for the firing circuit, writing the session variables to the first digital code plug, and simultaneously storing the session variables in the firing circuit.

A local message is generated at 604 when the first digital code plug is integrated in communicative combination with a firing circuit and transmitted at 606 to the firing circuit's host to notify it that the first digital code plug is integrated with the firing circuit. The first digital code plug is then separated at 608 from communicative combination with the firing circuit. At that time a local message is generated at 610 and transmitted at 612 to the host to notify it that the first digital code plug is no longer integrated.

A second digital code plug is integrated at 614 in communicative combination with at least two of a second set of firing circuits. The second set is mounted to a different host (e.g., a remotely controlled vehicle) than the first set. Each integration includes generating a group of one-time random session variables for the firing circuit, writing the session variables to the second digital code plug, and simultaneously storing the session variables in the firing circuit.

A local message is generated at 616 when the second digital code plug is integrated in communicative combination with a firing circuit and transmitted at 618 to the firing circuit's host to notify it that the second digital code plug is integrated with the firing circuit. The second digital code plug is then separated at 620 from communicative combination with the firing circuit. At that time a local message is generated at 622 and transmitted at 624 to the host to notify it that the second digital code plug is no longer integrated.

The first digital code plug is integrated at 626 in communicative combination with the firing control panel. A local message is generated at 628 and transmitted at 630 to the firing control panel's host to notify the host that the first digital code plug has been integrated.

A user selects at 632 a first remote mission payload and corresponding first firing circuit to be controlled by the firing control panel. The user actuates an arming mechanism of the firing control panel at 634 to transmit an ARM command message embodying a session variable for the first firing circuit and read from the first digital code plug to arm the first firing circuit. The user then actuates a firing mechanism of the firing control panel at 636 to transmit a first FIRE message embodying another session variable for the first firing circuit and read from the first digital code plug to activate the first firing circuit to fire the first remote mission payload.

The user then separates the first digital code plug from the control panel at 638, which results in generation 640 and transmission 642 of a local message to the firing control panel's host to notify the host that the first digital code plug has been integrated. The method is then repeated with the second digital code plug, starting at 626.

Figure 10A:
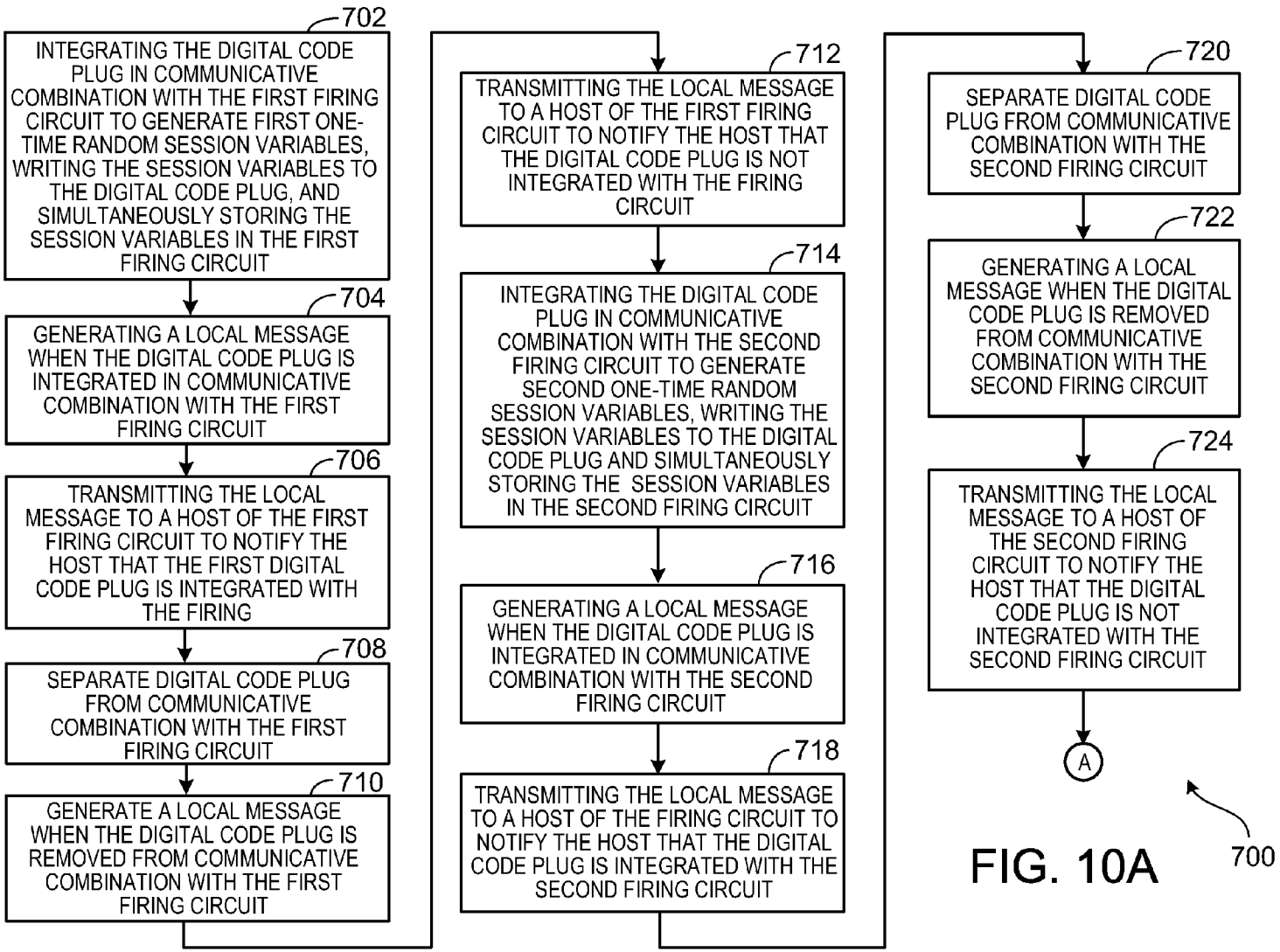
FIG. 10 is a flow chart providing an exemplary arrangement of operations for operating a remote digital firing system.
Figure 10B:
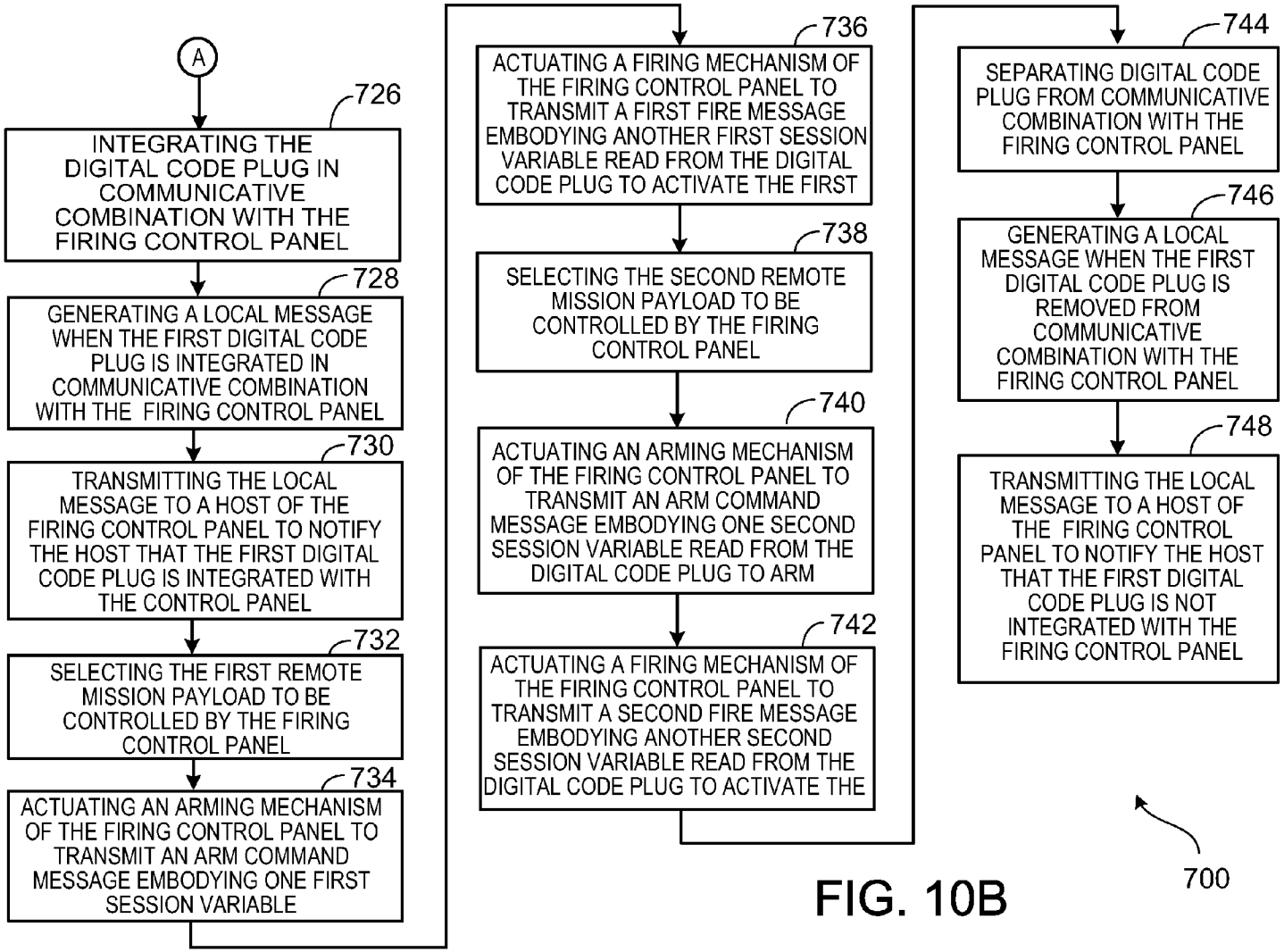

Referring to FIG. 10, and in another aspect, a method 700 of operating a remote digital firing system is shown. The digital code plug is integrated at 702 in communicative combination with a first firing circuit to generate first one-time random session variables, which are written to the digital code plug and stored in the first firing circuit. A local message is generated at 704 and transmitted at 706 to a host to notify it that the digital code plug is integrated with the firing circuit. The digital code plug is separated at 708 from the first firing circuit, generating at 710 and transmitting at 712 a local message to the host of the first firing circuit to notify the host that the digital code plug is not integrated with the firing circuit.

The digital code plug is integrated at 714 in communicative combination with the second firing circuit to generate second one-time random session variables, writing the session variables to the digital code plug and simultaneously storing the session variables in the second firing circuit. A local message is generated at 716 and transmitted at 718 to the host of the second firing circuit to notify the host that the digital code plug is integrated with the second firing circuit. The digital code plug is separated at 720 from the second firing circuit, generating at 722 and transmitting at 724 a local message to the host of the second firing circuit that the digital code plug is not integrated with the second firing circuit.

The digital code plug is integrated at 726 in communicative combination with the firing control panel. A local message is generated at 728 and transmitted at 730 to the host of the firing control panel to notify the host that the digital code plug is integrated with the second firing circuit.

A user selects at 732 the first remote mission payload to be controlled by the firing control panel. An arming mechanism is actuated at 734 to transmit an ARM command message embodying one first session variable read from the digital code plug to arm the first firing circuit. The user actuates at 736 a firing mechanism to transmit a first FIRE message embodying another first session variable read from the digital code plug to activate the first firing circuit to fire the first remote mission payload.

A user selects at 738 a second remote mission payload to be controlled by the firing control panel. An arming mechanism is actuated at 740 to transmit an ARM command message embodying one second session variable read from the digital code plug to arm the second firing circuit. The user actuates at 742 a firing mechanism to transmit a second FIRE message embodying another second session variable read from the digital code plug to activate the second firing circuit to fire the second remote mission payload.

The digital code plug is then separated from the firing control panel at 744, whereby a local message is generated at 746 and transmitted at 748 to a host of the firing control panel to notify the host that the digital code plug is no longer integrated with the firing control panel.

Figure 11:
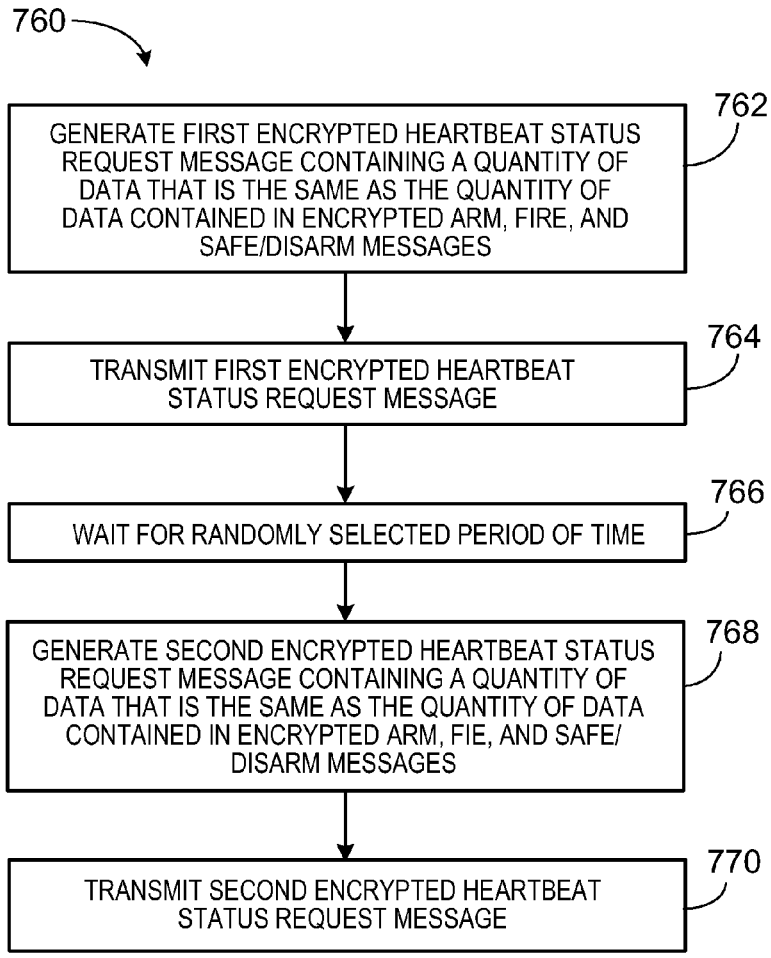
FIG. 11 is a flow chart providing an exemplary arrangement of operations for hiding the intent of an operator of a remote digital firing system for firing a remote missile payload.

Referring to FIG. 11 and in another aspect, a method 760 for hiding the intent of an operator of a remote digital firing system for firing a remote mission payload is shown. A first encrypted heartbeat status request message is generated at 762 containing a quantity of data that is the same as the quantity of data contained in encrypted arm, fire, and safe/disarm messages. The first encrypted heartbeat status request message is transmitted at 764. After a randomly selected period of time (766), a second encrypted heartbeat status request message is generated at 768, also containing a quantity of data that is the same as the quantity of data contained in encrypted arm, fire, and safe/disarm messages, and transmitted at 770. By waiting a randomly selected period of time between status request messages, other transmissions, such as communication of ARM or FIRE messages will not stand out as aperiodic in relation to the heartbeat status request messages.

Figure 12:
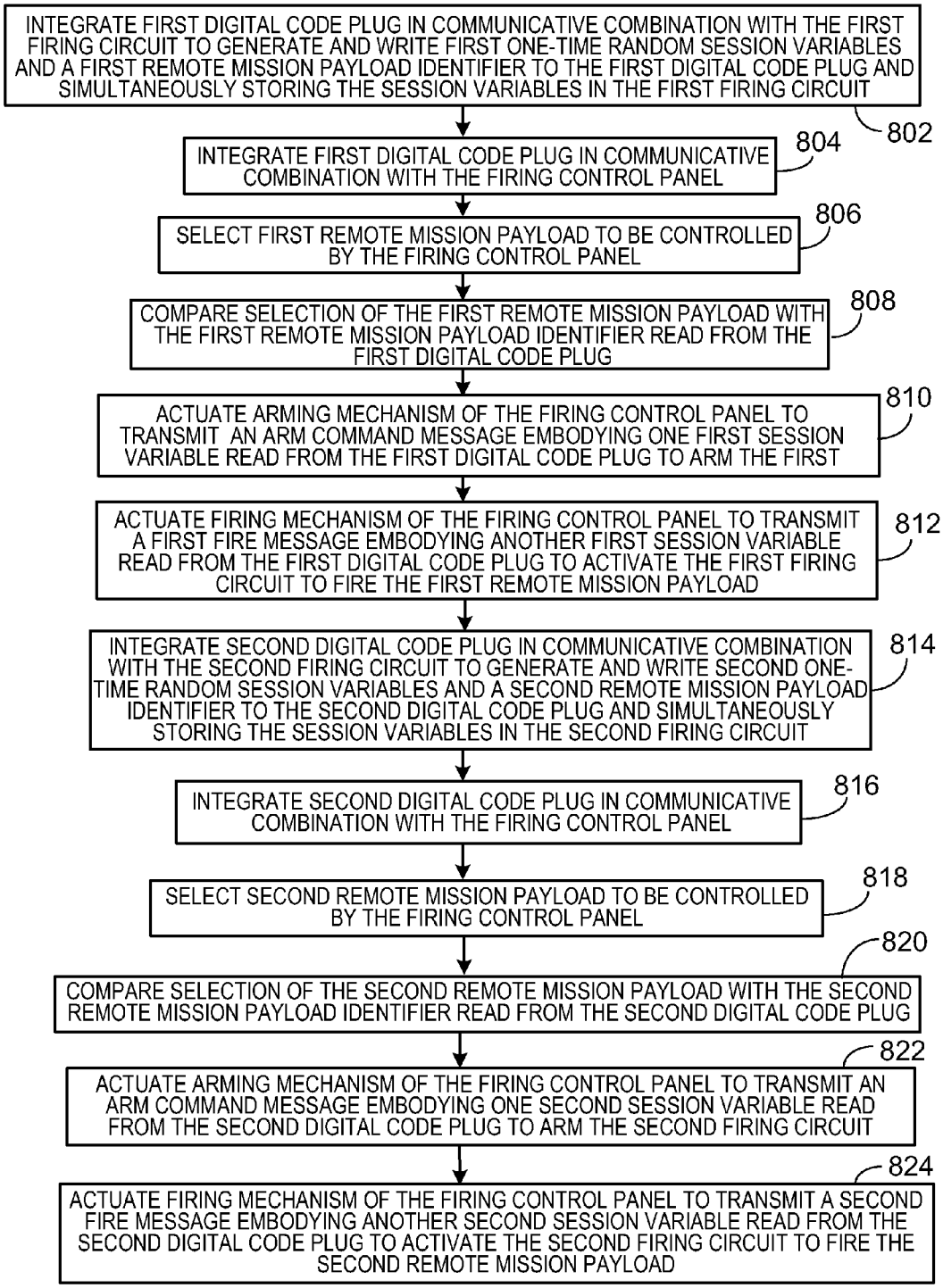
FIG. 12 is a flow chart providing an exemplary arrangement of operations for operating a remote digital firing system.

Referring to FIG. 12 and in another aspect, a method of a method 800 of operating a remote digital firing system that includes first and second firing circuits, first and second digital code plugs, and a firing control panel to fire first and second remote mission payloads communicatively coupled to the first and second firing circuits, is shown.

The first digital code plug is integrated at 802 in communicative combination with the first firing circuit to generate and write first one-time random session variables and a first remote mission payload identifier to the first digital code plug and simultaneously storing the session variables in the first firing circuit. The first digital code plug is integrated at 804 in communicative combination with the firing control panel and the first remote mission payload to be controlled by the firing control panel is selected at 806. The selection of the first remote mission payload is compared at 808 with the first remote mission payload identifier read from the first digital code plug. An arming mechanism is actuated at 810 to transmit an ARM command message embodying one first session variable read from the first digital code plug to arm the first firing circuit. A firing mechanism is actuated at 812 to transmit a first FIRE command message embodying another first session variable read from the first digital code plug to activate the first firing circuit to fire the first remote mission payload.

The second digital code plug is integrated at 816 in communicative combination with the second firing circuit to generate and write second one-time random session variables and a second remote mission payload identifier to the second digital code plug and simultaneously storing the session variables in the second firing circuit. The second digital code plug is integrated in communicative combination with the firing control panel and the second remote mission payload to be controlled by the firing control panel is selected at 818. The selection of the second remote mission payload is compared at 820 with the second remote mission payload identifier read from the second digital code plug to verify that the correct payload has been selected. An arming mechanism is actuated at 822 to transmit an ARM command message embodying one second session variable read from the second digital code plug to arm the second firing circuit. A firing mechanism is actuated at 824 to transmit a second FIRE command message embodying another second session variable read from the second digital code plug to activate the second firing circuit to fire the second remote mission payload.

Figure 13:
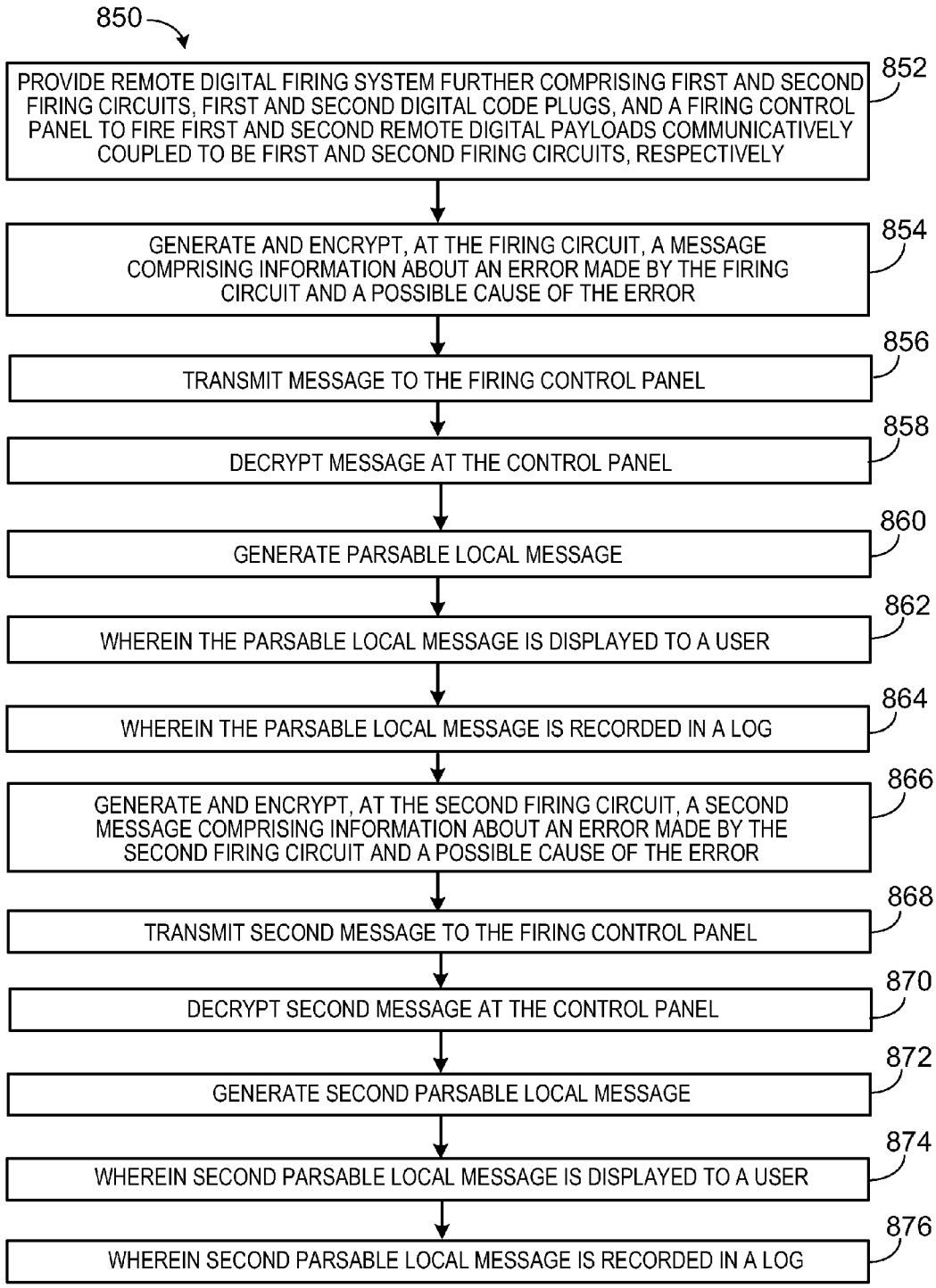
FIG. 13 is a flow chart providing an exemplary arrangement of operations for diagnosing a remote digital firing system remotely.

Referring to FIG. 13 and in another aspect, a method 850 of diagnosing a remote digital firing system remotely and securely, without revealing to an observer that the status of the system is shown. A remote digital firing system is provided at 852, including a firing circuit, a digital code plug, and a firing control panel to fire a remote mission payload communicatively coupled to the firing circuit. At 854, a message comprising information about an error made by the firing circuit and a possible cause of the error is generated and encrypted at the firing circuit and transmitted at 856 to the firing control panel. The message is decrypted 858 at the control panel a parsable local message is generated at 860 and displayed to a user at 862 and recorded in a log at 864. The process is repeated for the second firing circuit at 866-876. The operator of the remote digital firing system doesn't have to be present at the firing circuits to diagnose problems.

A variety of modification and variations of the present invention are possible in light of the above teachings. It is therefore to be understood that, within the scope of the appended claims, the present invention may be practiced other than as specifically described herein.

The invention claimed is:

1. A remote digital firing system for selectively firing a plurality of remote mission payloads, the remote digital firing system comprising:

a remote controlled vehicle;

a first set of firing circuits communicatively coupled to and operative to fire a corresponding first set of remote mission payloads attached to the remote controlled vehicle and a second set of firing circuits communicatively coupled to and operative to fire a corresponding second set of remote mission payloads attached to the remote controlled vehicle;

a firing control panel communicatively linked by a communications link to the first and second sets of firing circuits and the remote controlled vehicle, wherein the communications link carries commands for the first and second sets of firing circuits and control commands for the remote controlled vehicle;

a first digital code plug configured to be integrated in communicative combination with each firing circuit of the first set of firing circuits and the firing control panel;

a second digital code plug configured to be integrated in communicative combination with each firing circuit of the second set of firing circuits and the firing control panel; and a payload selector switch for selecting a remote mission payload.

2. The remote digital firing system of claim 1, wherein the first firing circuit of the first set is operative, with the first digital code plug integrated in communicative combination therewith to generate first one-time random session variables to the first digital code plug and to simultaneously store the first one-time random session variables internally in the firing circuit.

3. The remote digital firing system of claim 2, wherein the firing control panel is operative, with the first digital code plug integrated in communicative combination therewith and the payload selector switch configured to select the mission payload corresponding to the firing circuit, to generate and transmit first messages having the first one-time random session variables embodied therein to the firing circuit.

4. The remote digital firing system of claim 3, wherein the firing circuit validates the first messages by comparing the first one-time random session variables embodied in the first messages with the internally stored first one-time random session variables prior to firing the remote mission payload.

5. The remote digital firing system of claim 4, wherein the first one-time random session variables includes a first Safe/Disarm code for disarming the firing circuit.

6. The remote digital firing system of claim 1, wherein the second firing circuit is operative, with the second digital code plug integrated in communicative combination therewith to generate and write second one-time random session variables to the second digital code plug and to simultaneously store the second one-time random session variables internally in the second firing circuit.

7. The remote digital firing system of claim 6, wherein the firing control panel is operative, with the second digital code plug integrated in communicative combination therewith and the payload selector switch configured to select the second mission payload, to generate and transmit second messages having the second one-time random session variables embodied therein to the second firing circuit.

8. The remote digital firing system of claim 7, wherein the second firing circuit validates the second messages by comparing the second one-time random session variables embodied in the second messages with the internally stored second one-time random session variables prior to firing the second remote mission payload.

9. The remote digital firing system of claim 8, wherein the second onetime random session variables includes a second Safe/Dism code for disarming the second firing circuit.

* * * * *

UNITED STATES PATENT AND TRADEMARK OFFICE

CERTIFICATE OF CORRECTION

PATENT NO. : 8,109,191 B1
APPLICATION NO. : 12/469255
DATED : February 7, 2012
INVENTOR(S) : Pavlo E. Rudakevych et al.

It is certified that error appears in the above-identified patent and that said Letters Patent is hereby corrected as shown below:

Column 30, Line 51, In Claim 9, delete "Safe/Dism" and insert -- Safe/Disarm --, therefor.

Signed and Sealed this
Third Day of April, 2012

David J. Kappos

David J. Kappos
*Director of the United States Patent and Trademark Office*